US008727917B2

(12) United States Patent
Vander Pol et al.

(10) Patent No.: US 8,727,917 B2
(45) **Date of Patent: *May 20, 2014**

(54) BALL BAT HAVING PERFORMANCE ADJUSTING ANNULAR MEMBER

(71) Applicant: Wilson Sporting Goods Co., Chicago, IL (US)

(72) Inventors: Edwin D. Vander Pol, Beaverton, OR (US); Mark A. Fritzke, Portland, OR (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/867,176

(22) Filed: Apr. 22, 2013

(65) Prior Publication Data

US 2013/0237349 A1 Sep. 12, 2013

Related U.S. Application Data

(63) Continuation of application No. 12/884,337, filed on Sep. 17, 2010, now Pat. No. 8,449,412.

(60) Provisional application No. 61/347,025, filed on May 21, 2010.

(51) Int. Cl.
*A63B 59/06* (2006.01)

(52) U.S. Cl.
USPC ..... 473/566; 473/567

(58) Field of Classification Search
USPC ..... 473/457, 519, 520, 564–568
See application file for complete search history.

(56) References Cited

U.S. PATENT DOCUMENTS

| | | | | | |
|---|---|---|---|---|---|
| 3,727,295 | A * | 4/1973 | Gildemeister | 29/455.1 |
| 3,861,682 | A * | 1/1975 | Fujii | 473/520 |
| 4,746,117 | A * | 5/1988 | Noble et al. | 473/566 |
| 4,951,948 | A * | 8/1990 | Peng | 473/520 |
| 5,094,453 | A * | 3/1992 | Douglas et al. | 473/566 |
| 5,364,095 | A * | 11/1994 | Easton et al. | 473/566 |
| 5,494,280 | A * | 2/1996 | MacKay, Jr. | 473/520 |
| 5,676,610 | A * | 10/1997 | Bhatt et al. | 473/566 |
| 5,961,405 | A | 10/1999 | MacKay, Jr. | 473/566 |
| 5,964,673 | A * | 10/1999 | MacKay, Jr. | 473/566 |
| 6,398,675 | B1 * | 6/2002 | Eggiman et al. | 473/566 |
| 6,612,945 | B1 * | 9/2003 | Anderson | 473/566 |
| 6,729,983 | B1 * | 5/2004 | Vakili et al. | 473/566 |
| 6,869,372 | B1 * | 3/2005 | Higginbotham et al. | 473/566 |
| 6,949,038 | B2 * | 9/2005 | Fritzke | 473/566 |
| 7,850,554 | B2 * | 12/2010 | Burger | 473/567 |
| 8,435,143 | B2 * | 5/2013 | Vander Pol et al. | 473/566 |
| 8,449,412 | B2 * | 5/2013 | Vander Pol et al. | 473/566 |
| 2010/0160095 | A1 * | 6/2010 | Chauvin et al. | 473/564 |

* cited by examiner

*Primary Examiner* — Mark Graham
(74) *Attorney, Agent, or Firm* — Terence P. O'Brien

(57) ABSTRACT

A ball bat extending about a longitudinal axis. The bat includes a bat frame having a handle portion and a tubular barrel portion, a knob coupled to the handle portion; and an annular member. The bat has a proximal end, a distal end, a center of percussion and a length of at least thirty inches. The barrel portion has an inner surface. At least a portion of the inner surface of the barrel portion includes a first set of projections. The annular member includes an outer radial surface having a second set of projections. The annular member is positioned within the barrel portion such that the first set of projections engages the second set of projections to inhibit longitudinal movement of the annular member with respect to the barrel portion in at least one direction.

20 Claims, 15 Drawing Sheets

BALL BAT HAVING PERFORMANCE ADJUSTING ANNULAR MEMBER

RELATED U.S. APPLICATION DATA

This application is a continuation application of U.S. patent application Ser. No. 12/884,337 filed on Sep. 17, 2010, which claims the benefit of the filing date under 35 U.S.C. §119(e) of U.S. Provisional Patent Application Ser. No. 61/347,025, filed on May 21, 2010, which is hereby incorporated by reference in its entirety. This application is related to U.S. patent application Ser. No. 12/884,344 filed on Sep. 17, 2010.

FIELD OF THE INVENTION

The present invention relates to a ball bat having an annular member for adjusting the performance of the bat.

BACKGROUND OF THE INVENTION

Baseball and softball organizations periodically publish and update equipment standards and/or requirements including performance limitations for ball bats. It is not uncommon for ball bat manufacturers to adjust the design and/or construction of their ball bats to ensure that such bats satisfy the new or updated standards. In many instances, the challenge is to develop designs that fully satisfy such standards, while providing the player with beneficial characteristics, such as exceptional feel, consistency, reliability and performance.

One recently issued standard is the Bat-Ball Coefficient of Restitution ("BBCOR") Standard adopted by the National Collegiate Athletic Association ("NCAA") on May 21, 2009. The BBCOR Standard, which becomes effective on Jan. 1, 2011, is a principal part of the NCAA's effort, using available scientific data, to maintain as nearly as possible wood-like baseball bat performance in non-wood baseball bats.

Wood ball bats provide many beneficial features, however, they are prone to failure, and because wooden ball bats are typically solid (not hollow), wooden bats can be too heavy for younger players even at reduced bat lengths. Accordingly, there is a need to produce a ball bat that shares the many of the beneficial characteristics of wood bats without the negative characteristics, such as, limited durability, weight, limited design flexibility, etc. Non-wood bats provide greater design flexibility and are more reliable and durable than wood bats. Non-wood bats include bats formed of aluminum, other alloys, composite fiber materials, theanoplastic materials and combinations thereof.

Many baseball bats currently in the market are not designed or produced to meet the BBCOR Standard including the 0.500 BBCOR bat performance limit. Accordingly, a need exists for baseball bat constructions that can meet the BBCOR Standard including 0.500 BBCOR performance limit while retaining acceptable playability characteristics for players, including durability, feel, weight, etc. Additionally, there is a need for a design change or design improvement that can be made to existing bat constructions that would allow a bat construction that originally exceeds the 0.500 BBCOR to be adjusted with the addition of the design change or improvement to satisfy the 0.500 BBCOR requirement. There is also a need for a baseball bat construction that optimizes the performance of the bat under the BBCOR Standard and the 0.500 performance limit. It would be advantageous to provide a bat configuration or improvement to a bat configuration that can adjust the performance of a ball bat to meet a desired criteria, such as, for example, to perform more like a wood bat.

SUMMARY OF THE INVENTION

The present invention provides a ball bat extending about a longitudinal axis. The bat includes a bat frame, a knob and an annular member. The bat frame has a handle portion and a tubular barrel portion. The bat has a proximal end, a distal end, a center of percussion and a length of at least thirty inches. The barrel portion has an inner surface. The knob is coupled to the handle portion. The annular member is coupled to the inner surface of the barrel portion. The annular member has a center of mass and is positioned within the barrel portion such that the center of mass of the annular member is longitudinally spaced apart from the center of percussion of the bat by a first distance. The first distance is at least 0.25 inches. The annular member increases the moment of inertia of the bat, measured about an axis positioned six inches from the base of the knob of the bat, by no more than twenty percent.

According to a principal aspect of a preferred form of the invention, a ball bat includes a bat frame and an annular member. The bat frame has a handle portion and a tubular barrel portion. The bat has a proximal end, a distal end, a center of percussion and a length of at least thirty inches. The barrel portion has an inner surface. The annular member is positioned within the barrel portion and having a center of mass. The center of mass of the annular member is longitudinally spaced apart from the center of percussion of the bat by a first distance of at least 0.25 inches. The annular member has a weight within the range of 0.4 to 1.85 ounces. The bat is configured to provide a maximum BBCOR value of less than or equal to 0.500 when tested in accordance with the NCAA Standard for Testing Baseball Bat Performance.

According to another preferred aspect of the invention, a ball bat includes a bat frame having a handle portion and a barrel portion, and a performance adjusting annular member within the barrel portion. The annular member has an outer diameter, a weight within the range of 0.4 to 1.85 ounces and a radial cross-sectional area. The radial cross sectional area has a maximum height and a maximum width. The maximum height over the maximum width defines a first aspect ratio, and the outer diameter over the width defines a second aspect ratio. The first aspect ratio is at least 0.5 and the second aspect ratio is greater than 1.5. The annular member has at least first and second annular portions. The first annular portion extends over less than 50 percent of the width of the member and includes over sixty percent of the mass of the annular member.

According to another preferred aspect of the invention, a ball bat has a proximal end, a distal end and a length of at least thirty inches. The bat includes a bat frame having a handle portion and a barrel portion, and an annular member positioned within the barrel portion. The annular member operably engages the inner surface of the barrel portion. The annular member has a stiffness coefficient within the range of 9000 to 39000 lb/in and a weight within the range of 0.4 to 1.85 ounces.

This invention will become more fully understood from the following detailed description, taken in conjunction with the accompanying drawings described herein below, and wherein like reference numerals refer to like parts.

DETAILED DESCRIPTION OF THE INVENTION

Figure 1:
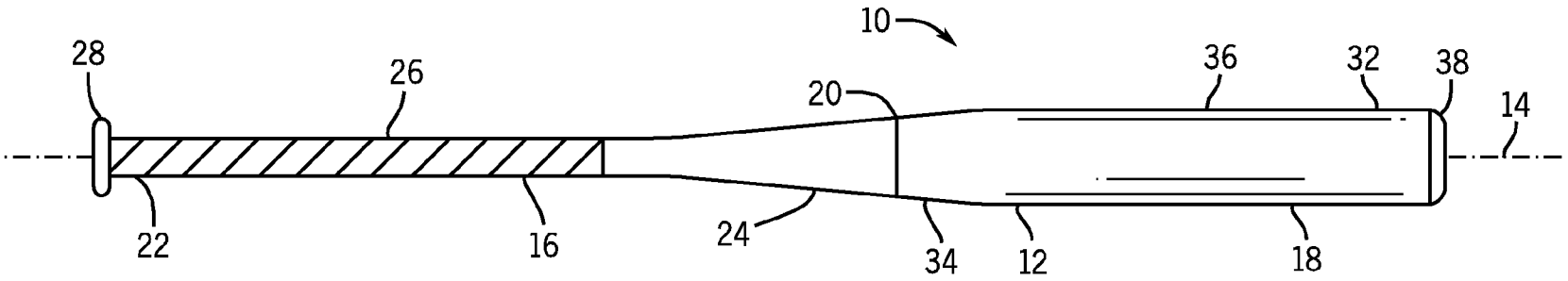
FIG. 1 is a side view of a ball bat in accordance with a preferred embodiment of the present invention.

Referring to FIG. 1, a ball bat is generally indicated at 10. The ball bat 10 of FIG. 1 is configured as a baseball bat; however, the invention can also be formed as a softball bat, a rubber ball bat, or other form of ball bat. The bat 10 includes a frame 12 extending along a longitudinal axis 14. The tubular frame 12 can be sized to meet the needs of a specific player, a specific application, or any other related need. The frame 12 can be sized in a variety of different weights, lengths and diameters to meet such needs. For example, the weight of the frame 12 can be formed within the range of 15 ounces to 36 ounces, the length of the frame can be formed within the range of 24 to 36 inches, and the maximum diameter of the barrel portion 18 can range from 1.5 to 3.5 inches. In one preferred embodiment of the present invention, the length of the bat frame is at least 30 inches.

The frame 12 has a relatively small diameter handle portion 16, a relatively larger diameter barrel portion 18 (also referred as a hitting or impact portion), and an intermediate tapered region 20. The intermediate tapered region 20 can be formed by the handle portion 16, the barrel portion 18 or a combination thereof. In one preferred embodiment, the handle and barrel portions 16 and 18 of the frame 12 can be formed as separate structures, which are connected or coupled together. This multi-piece frame construction enables the handle portion 16 to be formed of one material, and the barrel portion 18 to be formed of a second, different material. In an alternative preferred embodiment, the frame 12 can be a one-piece integral structure (not separate handle and barrel portions coupled together).

The handle portion 16 is an elongate structure having a proximal end region 22 and a distal end region 24, which extends along, and diverges outwardly from, the axis 14 to form a substantially frusto-conical shape for connecting or coupling to the barrel portion 18. Preferably, the handle portion 16 is sized for gripping by the user and includes a grip 26, which is wrapped around and extends longitudinally along the handle portion 16, and a knob 28 connected to the proximal end 22 of the handle portion 16. The handle portion 16 is formed of a strong, generally flexible, lightweight material, preferably a fiber composite material. Alternatively, the handle portion 16 can be formed of other materials such as an aluminum alloy, a titanium alloy, steel, other alloys, a thermoplastic material, a thermoset material, wood or combinations thereof.

Figure 2:
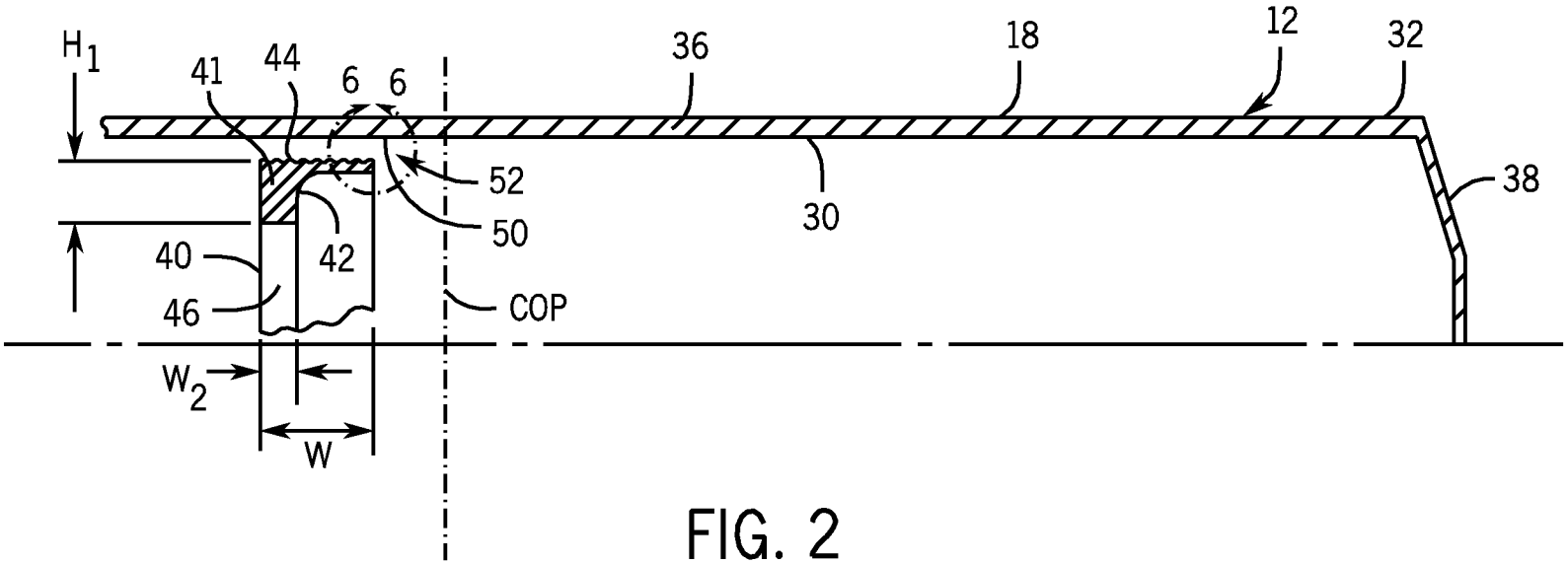
FIG. 2 is a longitudinal cross-sectional view of a barrel portion of the bat of FIG. 1 including an annular member.
Figure 3:
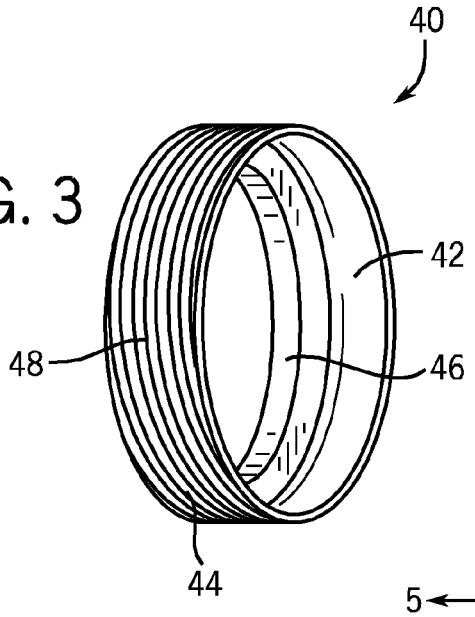
FIG. 3 is a side perspective view of the annular member of FIG. 2.
Figure 4:
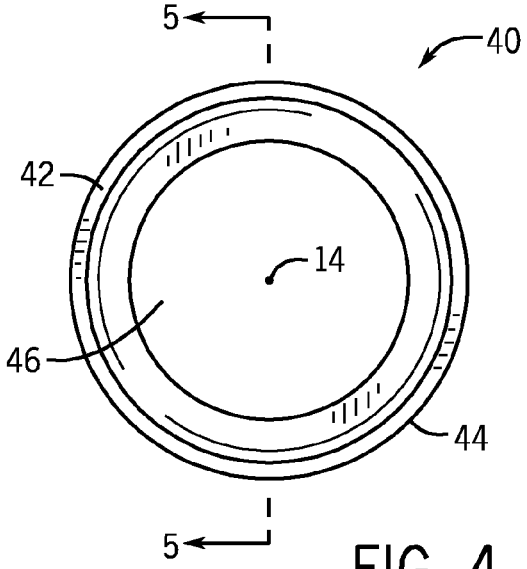
FIG. 4 is an end view of the annular member of FIG. 2.

Referring to FIGS. 1 and 2, the barrel portion 18 of the frame 12 is "tubular," "generally tubular," or "substantially tubular," each of these terms is intended to encompass softball style bats having a substantially cylindrical impact (or "barrel") portion as well as baseball style bats having barrel portions with generally frusto-conical characteristics in some locations. The barrel portion 18 extends along the axis 14 and has an inner surface 30, a distal end region 32, a proximal end region 34, and a central region 36 disposed between the distal and proximal end regions 32 and 34. The proximal end region 34 converges toward the axis 14 in a direction toward the proximal end of the barrel portion 18 to form a frusto-conical shape that is complementary to the shape of the distal end region 24 of the handle portion 16. The barrel portion 18 can be directly connected to the handle portion 16. The connection can involve a portion, or substantially all, of the distal end region 24 or tapered region 20 of the handle portion 16 and the proximal end region 34 of the barrel portion 18. Alternatively, an intermediate member can be used to space apart and/or attach the handle portion 16 to the barrel portion 18. The intermediate member can space apart all or a portion of the barrel portion 16 from the handle portion 16, and it can be formed of an elastomeric material, an epoxy, an adhesive, a plastic or any conventional spacer material. In other alternative preferred embodiments, the handle portion and the barrel portion are formed as a one piece integral structure (not as separate handle and barrel portions coupled together). The bat 10 further includes an end cap 38 attached to the distal end 32 of the barrel portion 18 to substantially enclose the distal end 32.

The barrel portion 18 is formed of a strong, durable material, preferably an aluminum alloy or a fiber composite material. Alternatively, the barrel portion 18 can be formed of other materials such as a titanium alloy, steel, other alloys, a thermoplastic material, a thermoset material, wood or combinations thereof.

Referring to FIG. 2, in one preferred embodiment, an annular member 40 is shown with respect to a cross-section of a region of the barrel portion 18. Referring to FIGS. 2 through 5, the annular member 40 is a rigid, generally circular structure that generally forms a ring. The term "generally circular" is intended to include circular structures and structures that closely resemble a circle. The annular member 40 does not have to be a perfect circle. The annular member 40 is configured to engage the inner surface 30 of the barrel portion 18 and therefore will generally match the generally circular cylindrical shape of the inner surface 30 of the barrel portion 18. The annular member 40 preferably includes a circular ring body 42 having an outer radial surface 44. The ring body 42 defines a central opening 46. In alternative embodiments, the annular member can be a solid disk or a circular object that has spokes or other supports extending across the central opening of the ring body. The annular ring 40 is preferably formed of a lightweight, low-density, strong, and stiff material, such as, for example, an aluminum alloy. Alternatively, the annular member 40 can be formed of a magnesium alloy, a fiber composite material, other alloys, a thermoset material, a thermoplastic material, a ceramic or combinations thereof.

The annular member 40 preferably has a weight within the range of 0.4 to 1.85 ounces. The relatively light weight of the annular member 40 enables it to be placed into the barrel portion 18 of the bat 10 without significantly adversely affecting the moment of inertia of the bat 10. In a particularly preferred embodiment, the annular member 40 has a weight within the range of 0.65 to 1.3 ounces. In alternative preferred embodiments, the annular member can have a weight outside of the 0.4 to 1.85 ounces range.

The annular member 40 has a hoop stiffness that is proportional to a stiffness coefficient within the range of 9,000 to 39,000 lbs/in. The stiffness coefficient is determined through application of the following formula $EI/R^3$, where E is the modulus of elasticity or Young's modulus of the material of the annular member 40, and I is an area moment of inertia of a radial cross-sectional area 41 of the annular member 40 (also referred to as the second moment of inertia), and R is the radius from the center of the annular member (the axis 14 or typically the center of the opening defined by the annular member) to the centroid of the radial cross-sectional area 41 of the annular member 40. The centroid is the center of mass of an object of uniform density. The center of mass or centroid of the annular member 40 as a whole is at the center of the opening defined by the annular member 40 or the longitudinal axis 14 of the bat, and the centroid of the radial cross-sectional area 41 is taken at a single radial cross-section of the annular member. The centroid of an area is analogous to the center of gravity of a homogeneous body having a uniform density. In a particularly preferred embodiment, the annular member 40 has a stiffness coefficient within the range of 12,000 to 18,000 lbs/in. In an alternative approach, the hoop stiffness can be measured by applying a load to the radial outer surface 44 of the annular member 40, and measuring deflection of the annular member 40.

The annular member 40 is positioned within, and coupled to the barrel portion 18 of the bat frame 12. Referring to FIGS. 2, 3, 6 and 7*a* in one preferred embodiment, the annular member 40 includes a first set of projections 48 outwardly extending from the outer radial surface 44. The first set of projections 48 is configured to inhibit movement of the annular member 40 within the barrel portion 18 along the longitudinal axis 14. The first set of projections 48 are detents or serrations that are configured to engage the inner surface 30 of the barrel portion 18.

Figure 6:
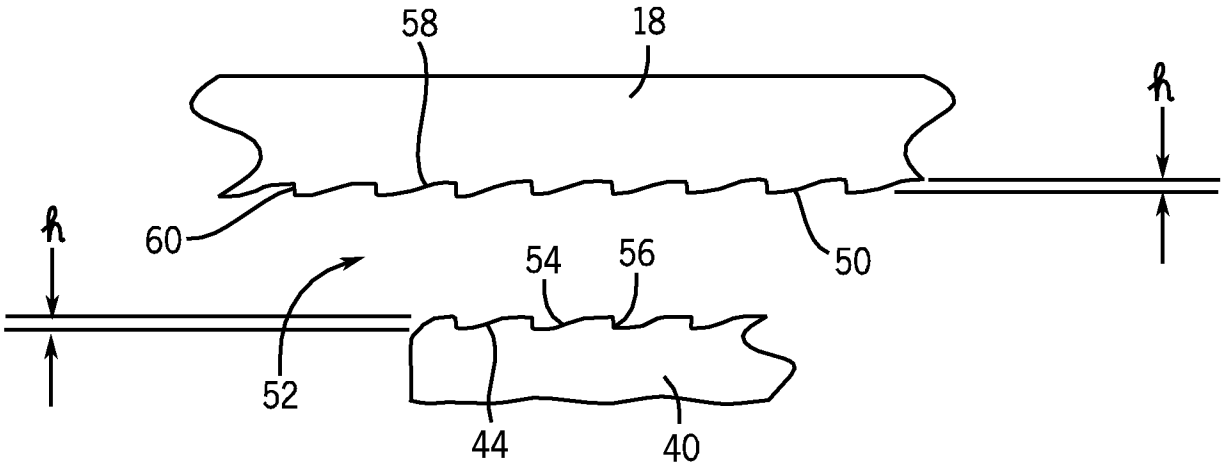
FIG. 6 is a cross-sectional view of the barrel portion of the bat and the annular member of section 6 of FIG. 2.

In one preferred embodiment, the inner surface 30 of the barrel portion 18 can include a corresponding or second set of projections 50 formed into a ring engaging region 52 of the barrel portion 18. The first set of projections 48 can be a plurality of serrations wherein each serration includes a first edge 54 that is gradually sloped with respect to the outer radial surface 44 and a second edge 56 that is more sharply sloped with respect to the outer radial surface such that the second edge is closer to being perpendicular to the outer radial surface 44 than the first edge 54. The second set of projections 50 can have corresponding serrations with third and fourth edges 58 and 60 that are preferably arranged in the opposite configuration of the first and second edges 54 and 56. The arrangement of the edges 54, 56, 58 and 60 enables the annular member to positioned or moved about the longitudinal axis 14 in a first direction (such as during initial assembly), but substantially prevent the annular member 40 from moving in the opposite longitudinal direction. For example, referring to FIGS. 2 and 6, the edges 54, 56, 58 and 60 are configured to allow for the annular member 40 to be inserted into the barrel portion 18 from the distal end region 32 of the barrel portion 18 and moved to the desired position within the barrel portion 18. In FIGS. 2 and 6, the barrel portion 18 and the annular member 40 are shown spaced apart from each other for purposes of showing the edges 54, 56, 58 and 60. In actual assembly, the barrel portion 18 and the annular member 40 are engaged to and contact each other. The gradually sloped first and third edges 54 and 58 allow for movement of the annular member 40 during its installation in a direction extending toward the handle portion 16. The second and fourth edges 56 and 60 are sharper and are configured to inhibit movement of the annular member 40 in a direction toward the end cap 38. In one preferred embodiment, the serrations or detents of the first and second sets of projections 48 and 50 have radial height, h, within the range of 0.002 to 0.060 inch. In an alternative preferred embodiment, the first, second, third and fourth edges of the first and second set of projections 48 and 50 can be reversed to inhibit movement in an opposite direction. In other alternative preferred embodiments, the angles of one or more of the first, second, third and fourth edges of the first and second set of projections can be varied.

Figure 7D:
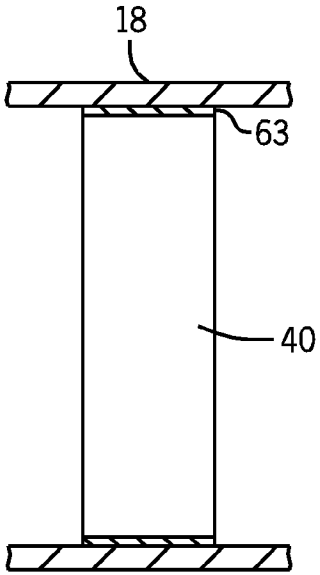
FIG. 7*a* through 7*d* illustrate side views of annular members in a sectional view of a barrel portion of a bat according to alternative preferred embodiments of the present invention.
Figure 7C:
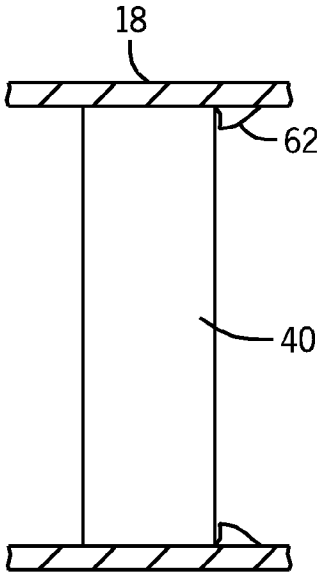
Figure 7B:
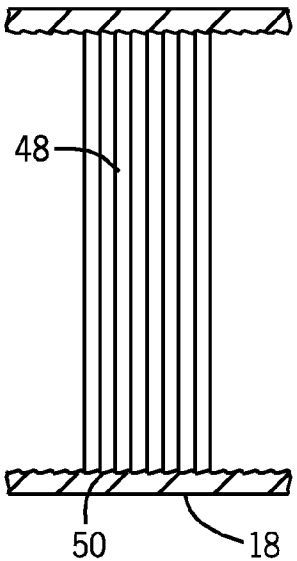
Figure 7A:
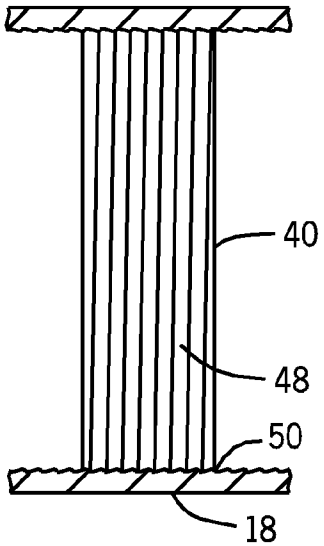

Referring to FIG. 7*a*, in one preferred embodiment, the first and second sets of projections 48 and 50 can be helical or spiral threads enabling the annular member 40 to be threadedly connected to the barrel portion 18. Referring to FIG. 7*b*, in an alternative preferred embodiment, the first and second set of projections 48 and 50 are configured to be parallel with respect to each other in a non-helical or non-threaded manner.

Referring to FIG. 7*c*, in alternative preferred embodiments, the annular member 40 can be formed without a first set of projections 48. Still further, a stop 62 can inwardly extend from the inner surface 30 of the barrel portion 18 to prevent movement of the annular member 40 with respect to the barrel portion 18 in a first longitudinal direction. The stop 62 can be used along with one or more of the sets of projections, interference fits, adhesives or other fastening means to securely position the annular member 40 within the barrel portion 18. Referring to FIG. 7*d*, a layer of material 63, such as an elastomeric material, can be applied to the outer peripheral edge of the annular member 40. The layer of material 63 can be used to couple the annular member to the inner surface of the barrel portion 18.

In other alternative preferred embodiments, the annular member can be secured to the inner surface 30 of the barrel portion 18 through an interference fit, a press fit, a transitional or a locational fit and with or without one or both of the first and second sets of projections. In one particularly preferred embodiment, an interference fit of 0.010 inch can be used. In other embodiments, other amounts of interference fit can be applied. In other alternative preferred embodiments, the annular member can be secured to the inner surface of the barrel through the use of an adhesive, such as an epoxy adhesive. One example of a suitable epoxy adhesive is Loctite® 290 brand adhesive provided by Henkel Corporation of Rocky Hill, Conn. Alternatively, other suitable adhesives can include Loctite® Nos. 638, 603, 620 and 567, and Permatex® Threadlocker No. PX 27100 from Permatex of Hartford, Conn., which can also be used alone or in combination with the other adhesives. The adhesive can be used with or without the first and second set of projections on the annular member 40 or the inner surface 30 of the barrel portion 18. The annular member 40 must be securely positioned within the barrel portion 18 such that the annular member 40 cannot move along the longitudinal axis during use or after repeated use.

Figure 5:
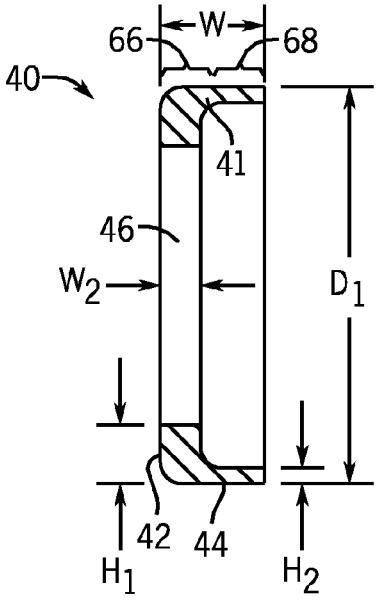
FIG. 5 is a cross-sectional view of the annular member taken about line 5-5 of FIG. 4.

Referring to FIGS. 2 and 5, the shape of the annular member 40 is important for achieving the desired concentrated stiffness and the desired bat performance. FIGS. 2 and 5 illustrate one preferred radial cross-sectional shape of the annular member for applying concentrated stiffness to the barrel portion of the bat. Other annular member constructions having different radial cross-sectional shapes providing the desired concentrated stiffness can also be used.

The shape of the annular member can be expressed in terms of aspect ratios. It has been determined that increasing the thickness (or height) of the annular member 40 with respect to its width provides beneficial performance characteristics. For example, the increased thickness increases the stiffness of the annular member 40 (and the stiffness coefficient) while the reduced width enables the annular member 40 to be optimally positioned at the desired distance from the center of percussion of the bat 10. A first aspect ratio of the annular member 40, also referred to as the stiffness aspect ratio, is defined by the maximum height, $H_1$, of the annular member 40 over the width, W, of the annular member 40. The first aspect ratio is preferably at least 0.5. A second aspect ratio is defined by the inside diameter of the barrel portion 18 at the location where the annular member 40 is positioned within the barrel portion 18 over the width W of the annular member. The second aspect ratio is preferably at least 1.5. A third aspect ratio can be defined by the outer diameter of the annular member 40, $D_1$, over the width, W, of the annular member 40. The third aspect ratio is preferably at least 1.5. Generally, the second and third aspect ratios will be approximately equal to each other because the inside diameter of the barrel portion 18 at the location of the annular member 40 should be substantially the same as the outside diameter of the annular member 40. The first, second and third aspect ratios allow for the annular member 40 to be light in weight and positionable to the desired position within the barrel portion 18 of the bat 10.

Referring to FIG. 5, in one preferred embodiment, the annular member 40 includes a first annular portion 66 and at least a second annular portion 68. The first annular portion 66 defines a ring and includes a width, such as $W_2$, that is less than 50 percent of the width W. Accordingly, the ratio of W2 to W is less than 0.5. The maximum height, $H_1$, of the annular member 40 is preferably defined by the first annular portion 66. The first annular portion 66 preferably defines over sixty (60) percent of the mass of the annular member 40. In one particularly preferred embodiment, the first annular portion 66 defines over seventy (70) percent of the mass of the annular member 40. In one preferred embodiment, the first annular portion 66 is positioned at one edge or side of the annular member 40 and the second annular portion 68 is positioned at the opposite side or edge of the annular member 40. In alternative preferred embodiments, the first annular portion 66 can be more centrally positioned about the width W of the annular member or at the opposite side or edge of the annular member. If the first annular portion 66 is more centrally positioned about the width W, the second annular portion and a third annular portion can be positioned on opposing sides of the first annular portion.

The increased mass of the first annular portion 66 contributes to the increased concentrated stiffness (and stiffness coefficient) of the annular member 40 and enables the increased mass and stiffness location to be targeted to the proper, desired position within the barrel portion. The second annular portion 68 preferably has an average height, $H_2$, that is less than 50 percent of the maximum height, H. In one preferred embodiment, the width W is within the range of 0.4 to 0.7 inch, the width $W_2$ is within the range of 0.05 to 0.3 inch, the maximum height, $H_1$, is within the range of 0.3 to 0.5 inch, the height $H_2$ is within the range of 0.05 to 0.15 inch, and the outside diameter of the annular member 40 is approximately 2.365 inches. In alternative preferred embodiments, other dimensions can be applied to the height, width and diameter values.

In alternative preferred embodiments, the annular member can be formed of two or more narrow rings positioned end to end that collectively fall within the first, second and/or third aspect ratios. In another alternative preferred embodiment, the outer radial surface of the annular member can be formed of a first material and the remaining regions of the annular member can be formed of one or more different materials. For example, the annular member can be formed with a ceramic outer layer or a plasma coating to enhance its hardness, strength, stiffness and/or corrosion resistance.

The configuration and position of the annular member 40 within the bat frame 12 can be critical to the optimal performance of the bat 10 under bat performance standards such as the BBCOR standard. The balance point, moment of inertia and the center of percussion of the bat 10, and of baseball and softball bats generally, can be determined using the ASTM Standard F2398-04 entitled *Standard Test Method for Measuring Moment of Inertia and Center of Percussion of a Baseball or Softball Bat*. The balance point, BP, is the distance to the center of mass of a ball bat measured from the distal end of the bat knob. The center of percussion, COP, is also known as the center of oscillation or the length of a simple pendulum with the same period as a physical pendulum as in a bat oscillating on a pivot. The COP is often used synonymously with the term "sweet spot." The Moment of Inertia, MOI, is a measure of mass distribution relative to an axis of rotation. MOI is the product of the mass multiplied by the square of the distance to the mass, summed over the entire bat. The COP and the MOI are measured about a pivot point (or an axis perpendicular to the longitudinal axis 14 of the bat) positioned six inches from the base or outer proximal surface of the knob 28 of the bat 10. If calculated in accordance with ASTM Std. F-2398-04, MOI can be calculated as follows, wherein Bat Weight is W.

$$MOI = W*(BP-6.0)*COP$$

The NCAA adopted the BBCOR protocol or standard for certifying bats for use in NCAA baseball games. The NCAA requires BBCOR certification for all bat constructions that are produced from materials other than one-piece solid wood. Each length and weight class of a bat model must be tested. The BBCOR test protocol is based upon ASTM F2219, *Standard Test Methods for Measuring High-Speed Bat Performance* as modified by the NCAA BBCOR Protocol dated May 29, 2009. The current edition is ASTM F2219-09 published in July 2009. The BBCOR test protocol requires measuring and recording the MOI and BP of a bat according to ASTM F2398.

The NCAA BBCOR Protocol provides a minimum MOI Rule specifying the minimum allowable MOI for associated length classes of ball bat models. For example, a 34 inch bat must have an MOI of at least 9530 oz-in$^2$, a 33 inch bat must have an MOI of at least 8538 oz-in$^2$, a 32 inch bat must have an MOI of at least 7630 oz-in$^2$, and a 31 inch bat must have an MOI of at least 6805 oz-in$^2$.

The present invention provides for the optimal positioning and configuration of the annular member 40 within the bat frame 12 to fully satisfy the 0.500 limit of the BBCOR Standard, and for optimizing the performance of the bat along the barrel portion 18. In many ball bats, the area or location of maximum performance is at the COP or sweet spot of the bat. Accordingly, if one wished to dampen or reduce the performance of a particular bat construction by adding a stiffening ring within the barrel portion (e.g. reduce the BBCOR value of a bat at the COP to below 0.500), one could target the location of the COP as a desired position for the annular member 40. Another approach could involve placing one or more inserts within the barrel portion wherein each of the one or more inserts has widths extending across much of length of the barrel portion.

Contrary to expected results, it has been determined that placement of an annular member at the location of COP or about much of the length of the barrel portion produces BBCOR values and other performance characteristics that are undesirable. The values can be undesirable for such configurations because performance testing can indicate BBCOR values at locations away from the COP can be found to exceed the 0.500 BBCOR limit, or because adding one or more inserts throughout much of the barrel portion contributes excessive weight to the bat increasing the moment of inertia of the bat beyond acceptable values.

In accordance with a preferred embodiment of the present invention, the center of mass of the annular member 40 preferably longitudinally spaced apart from the COP of the bat 10 by a first distance. The first distance is preferably at least 0.25 inches, and more preferably at least 0.5 inches. In some particularly preferred embodiments, the first distance is at least 0.9 inches. Further, the center of mass of the annular member 40 is preferably longitudinally spaced apart from the COP in the direction of the handle portion 16 or the knob 28 of the bat 10. In this way, the location and weight of the annular member 40 produces a MOI for the bat 10 that is less than if the annular member was positioned at the COP or on the distal side of the COP. Accordingly, when the annular member 40 of the present invention is added to a bat, the MOI of the bat will increase by less than 20 percent. In other words, a bat formed without the annular member will have a MOI of X, and the same bat having the annular member 40 positioned and constructed in accordance with the present invention will result in an MOI value that is increased by less than 20 percent. The MOI values of such bats 10 with the annular member 40 meet the minimum MOI requirements of the BBCOR Standard.

Figure 8:
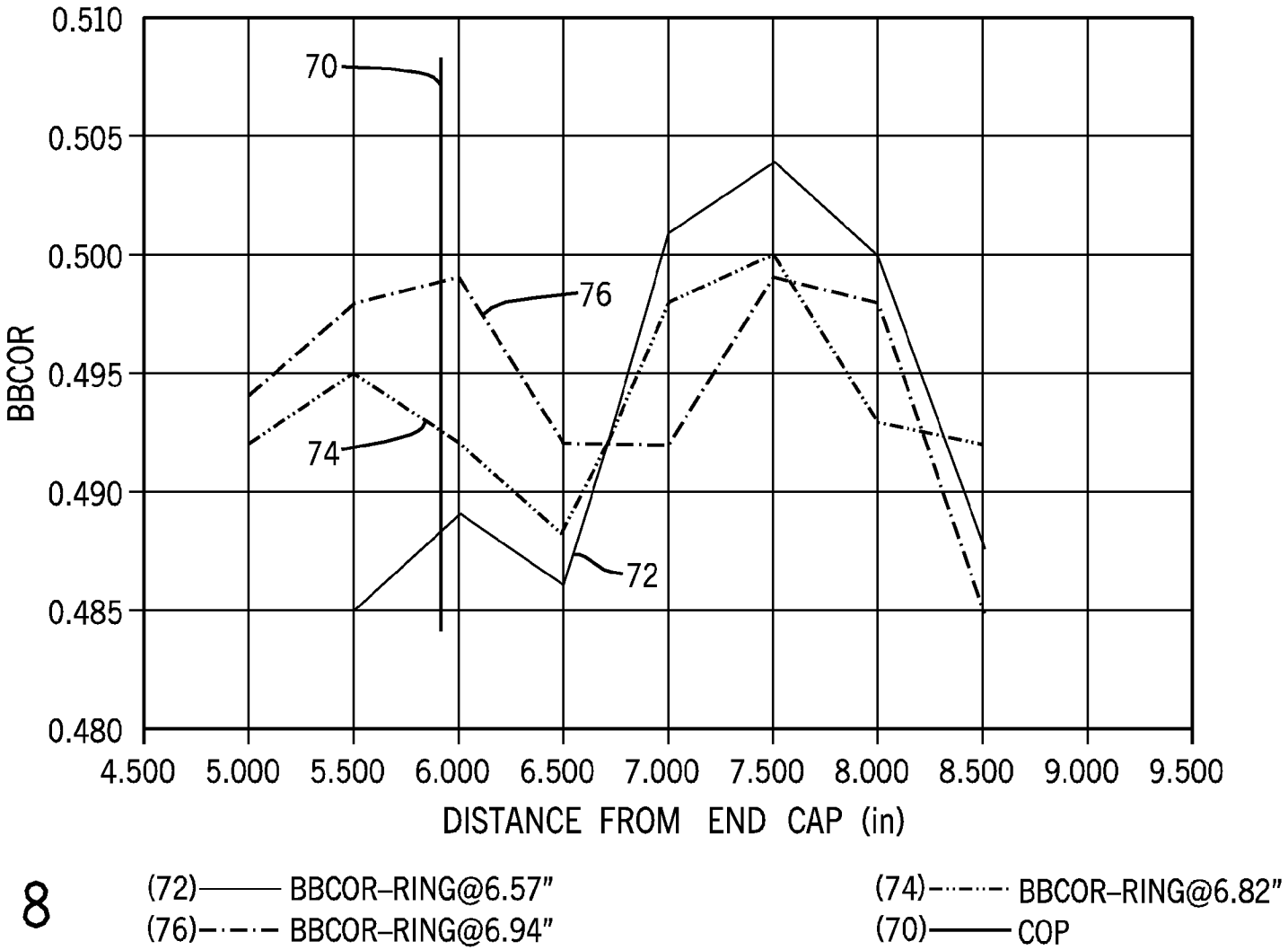
FIG. 8 is a graph illustrating BBCOR performance values taken at different distances along the barrel portion of a ball bat having an annular member in different locations within the barrel portion.

Referring to FIG. 8, a graphical representation of bat performance is illustrated for a baseball bat having an annular member (the annular member 40 of FIG. 5) positioned within the barrel portion of the bat at different positions. The bat used for the data of FIG. 8 is a thirty four inch long baseball bat having a weight of 31 ounces, an aluminum barrel portion and a separate handle portion formed of a fiber composite material. The x-axis of the graph of FIG. 8 represents the distance from the end cap 38 of the bat 10 and the y-axis represents the BBCOR value from the BBCOR test protocol. The vertical line 70 on the graph represents the location of the COP of the bat 10. The COP for the bat 10 of FIG. 8 is located at approximately 5.9 inches from the end cap 38 of the bat 10. FIG. 8 illustrates three lines (Line 72, Line 74 and Line 76) representing separate BBCOR tests performed on the bat. Lines 72, 74 and 76 are BBCOR performance profiles of three separate configurations of the bat 10 with the annular member 40 positioned at three separate longitudinal positions within the barrel portion 18. Each line shows BBCOR values taken from different locations about the barrel portion from the end cap 28 of the bat 10. The NCAA BBCOR Standard requires a baseball bat to have a BBCOR less than or equal to 0.500.

Line 72 represents a BBCOR performance profile obtained for the bat 10 having an annular member 40 positioned approximately 6.57 inches from the end cap 38 (and approximately 0.67 inches from the COP of the bat) to the centroid of the annular member 40. The BBCOR test results indicate that at the COP and adjacent to the COP, the BBCOR value is below 0.500. However, the test data taken at a position approximately 7.5 inches from the end cap of the bat 10, results in the BBCOR value being greater than 0.500. The bat having the BBCOR performance profile of Line 72 would not satisfy the NCAA BBCOR Standard requirements.

Line 74 represents the BBCOR performance profile obtained for the bat having the annular member 40 positioned at approximately 6.82 inches from the end cap 38 of the bat 10 to the centroid of the annular member 40. At this location, with the annular member 40 longitudinally spaced apart from the COP by approximately 0.92 inches, the BBCOR values for the bat 10 of line 74 are less than or equal to 0.500 BBCOR value. Therefore, the bat 10 having the BBCOR performance profile of line 74 would satisfy the NCAA BBCOR Standard requirements.

Line 76 represents the BBCOR performance profile obtained for the bat having the annular member 40 positioned at approximately 6.94 inches from the end cap 28 of the bat 10 to the centroid of the annular member 40. At this location, with the annular member 40 longitudinally spaced apart from the COP by approximately 1.04 inches, the BBCOR values for the bat 10 of line 76 are less than the 0.500 BBCOR value. Therefore, the bat 10 having the BBCOR performance profile of line 76 would satisfy the NCAA BBCOR Standard requirements.

Lines 72, 74 and 76 demonstrate that by positioning (longitudinally spacing) the annular member 40 further from the COP of the baseball bat, the maximum BBCOR values of the bat drop. Further, the BBCOR readings across the barrel portion become more uniform thereby making the performance of the barrel portion more consistent and responsive over a greater portion of the hitting area or hitting surface of the barrel portion of the bat. Further, by longitudinally spacing the annular member 40 away from the COP, preferably in the direction of the handle portion, the annular member 40 can be positioned away from the preferred or desired hitting area of the bat 10.

The lowering of the maximum BBCOR value of the bat 10 as the annular ring 40 is moved further from the COP of the bat is contrary to the expected result. The addition of a very stiff annular member to a baseball bat as expected lowers the performance of that bat. However, one of skill in the art could reasonably expect the most significant reduction in bat performance to result from placing the annular member directly at the COP.

The performance of the baseball bat 10 without an annular ring is much greater than with the application of annular ring within the barrel portion. Further, the placement of the annular ring at, or very close to, the COP reduces performance of the bat. However, the resulting BBCOR data when the annular member positioned at the COP does not result in a desirable BBCOR performance profile. Referring to FIG. 8, a more desirable BBCOR performance profile (Line 74 or Line 76) is obtained by longitudinally spacing the annular member further from the COP of the bat.

Figure 9:
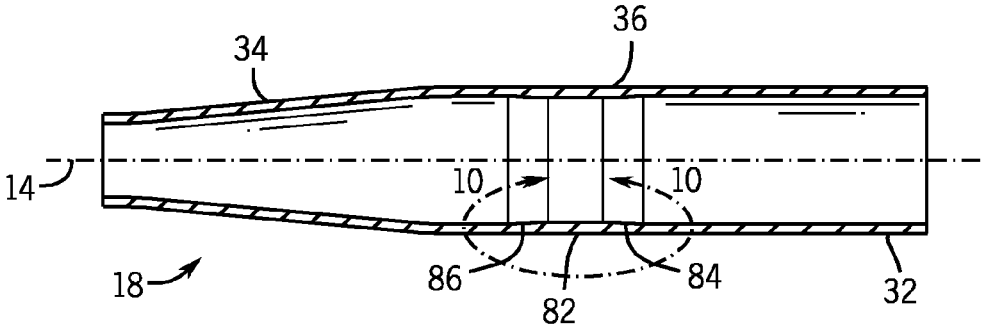
FIG. 9 is a longitudinal cross-sectional view of a barrel portion of a bat in accordance with an alternative preferred embodiment of the present invention.
Figure 10:
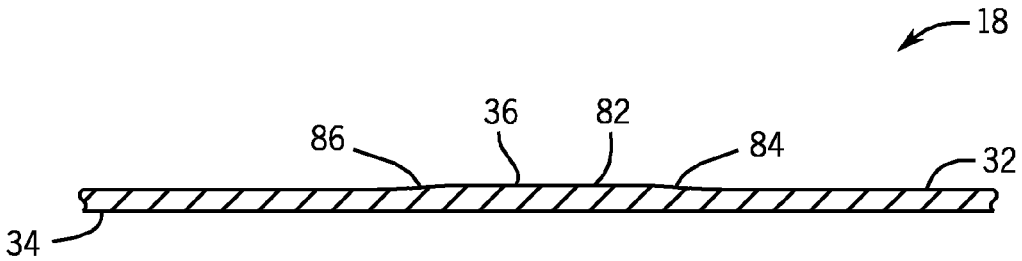
FIG. 10 is a longitudinal sectional view of the barrel portion of the bat of FIG. 9.
Figure 11:
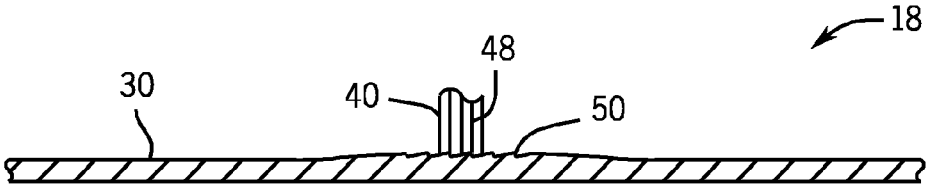
FIG. 11 is a longitudinal section view of the barrel portion of FIG. 9 having ring machining and an annular member.

Referring to FIGS. 9-11, an alternative preferred embodiment of the barrel portion 18 is illustrated. FIG. 9 is a longitudinal cross-sectional view of the barrel portion 18. The barrel portion 18 can be formed with a variable wall thickness. In particular, the central region 36 can be formed with an increased wall thickness. The wall thickness of the barrel portion 18 toward the distal and proximal end regions 32 and 34 of the barrel portion 18 is less than the wall thickness of the central region 36. In one particularly preferred embodiment, the wall thickness at or near the distal and proximal end regions 32 and 34 can be approximately 0.110 to 0.115 inches, and the wall thickness of the central region 36 can extend to approximately 0.160 inches. In other alternative preferred embodiments, the thickness of the central region 36 can extend to approximately 0.150 inches, to approximately 0.2 inches, or other dimensions.

Referring to FIGS. 9 and 10, a "tabletop" profile can be formed by the variable wall thickness of the barrel portion 18. The barrel portion 18 can include a central tubular area 82, first and second tapered regions 84 and 86, and the distal and proximal end regions 36 and 34. The first tapered region 84 can be positioned between the distal end region 36 and the central tubular area 82 and the second tapered region 86 can be positioned between the proximal end region 34 and the central tubular area 82. The central tubular area 82 can have an average wall thickness that is greater than the average wall thickness of either of the distal end region 36 or the proximal end region 34. The wall thickness of the first and second tapered regions 84 and 86 can vary from the central tubular area 82 to the distal and proximal end regions 36 and 34, respectively. The central tubular area 82 can have the largest wall thickness of the barrel portion 18 and the central tubular area 82 can be positioned at the middle of the central region 36 and can longitudinally extend from 0.25 to 4.0 inches, and more preferably from 0.5 to 1.5 inches. On the distal and proximal sides of the central tubular area 82 of the barrel portion 18, the wall thickness can taper from the from the distal and proximal sides of the area 82 toward the more uniform thickness of the distal and proximal end regions 32 and 34 to form the first and second tapered areas 84 and 86. The first and second tapered areas 84 and 86 can extend from 0.25 inches to 4.0 inches and preferably longitudinally extend from approximate 0.5 inch to 1.5 inches. The area 82 and the tapered areas 84 and 86 on either side of the thickest area 82 define the table top profile of the barrel portion 18.

Referring to FIG. 11, the second set of projections 50 can be machined into the inner surface 30 of the barrel portion 18. When the barrel portion 18 has the tabletop profile, the machining can be advantageously positioned only at the thickest area 82 or at the thickest area and a portion of the tapered areas 84 and 86. The incorporation of the tabletop profile into the wall thickness of the barrel portion 18 facilitates the machining of only a limited area of the barrel portion 18 to form the second set of projections 50, which facilitates the installation and placement of the annular member 40 within the barrel portion 18. The tabletop profile of the barrel portion 18 also provides extra material for machining of the second set of projections 50 into the inner surface 30 of the barrel portion 18 and avoids the issue of the machining of the second set of projections 50 reducing the wall thickness of the barrel portion 18 below a desirable or optimal thickness.

Figure 12:
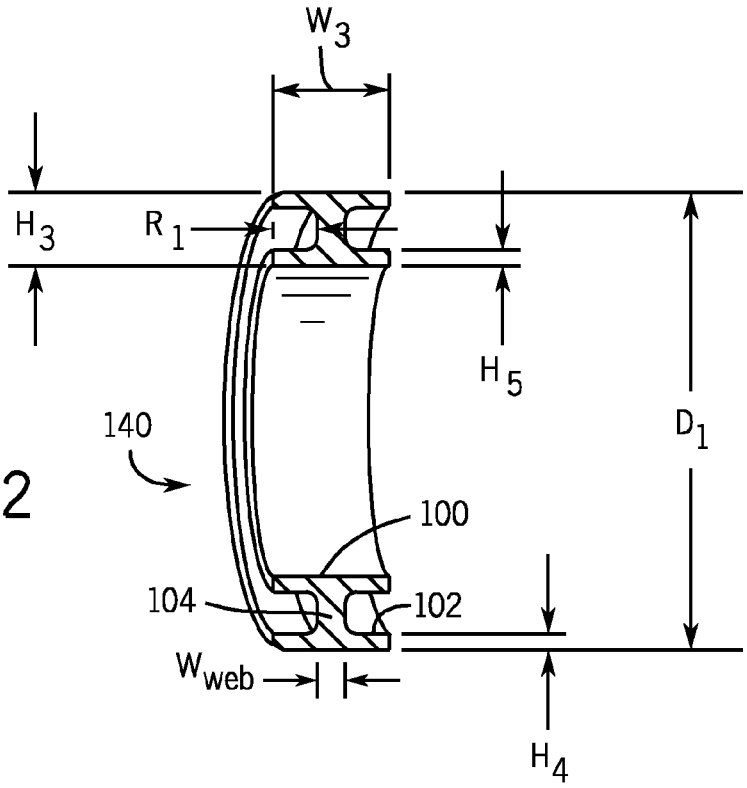
FIGS. 12 through 14 illustrate cross-sectional views of annular members in accordance with alternative preferred embodiments of the present invention.

Referring to FIG. 12, an alternative preferred embodiment of the annular member is shown as item number 140. The annular member 140 is substantially the same as the annular member 40, with the exception of the shape of radial cross-sectional area of the annular member 140. The annular member 140 has an I-beam or H-beam radial cross-sectional shape. The annular member 140 has a width $W_3$, which is the same as the width W of the annular member 40 and a height, $H_3$. The annular member 140 further includes inner and outer flanges 100 and 102 connected by a web 104 to form the I or H beam radial cross-sectional shape and define a recess having a depth $R_1$. The inner and outer flanges 100 and 102 have heights (or thicknesses) $H_5$ and $H_4$, respectively, and each have a width that is approximately equal to the width $W_3$. The web 104 has a width $W_{web}$. Like the first aspect ratio, the aspect ratio of $H_3$ over the width $W_3$ is preferably at least 0.5. Like the third aspect ratio, the aspect ratio of $D_1$ over the width $W_3$ is preferably at least 1.5. In one preferred embodiment, the heights $H_5$ and $H_4$ are substantially equal. In other preferred embodiments, the height $H_5$ and $H_4$ can be greater or less than each other. For example, the height $H_5$ can be approximately 0.005 inch less than the height $H_4$. The recess depth $R_1$ is preferably at least 30 percent of the width $W_3$.

The aspect ratio of the width of the inner flange 100, $W_3$, over the width of the web 104, $W_{web}$, is preferably at least 1.25. In a particularly preferred embodiment, the aspect ratio of the width of the inner flange 100, $W_3$, over the width of the web 104, $W_{web}$, is preferably at least 1.5. Similarly, the aspect ratio of the width of the outer flange 102, also $W_3$, over the width of the web 104, $W_{web}$, is preferably at least 1.25, and is more particularly preferred to be at least 1.5. In one particularly preferred embodiment, the annular member 140 is formed of magnesium, has a weight of approximately 0.77 ounce and a stiffness coefficient ($EI/R^3$) of approximately 17,314 lbs/in. In other preferred embodiments, other materials, weights and stiffness coefficients can be used.

Figure 13:
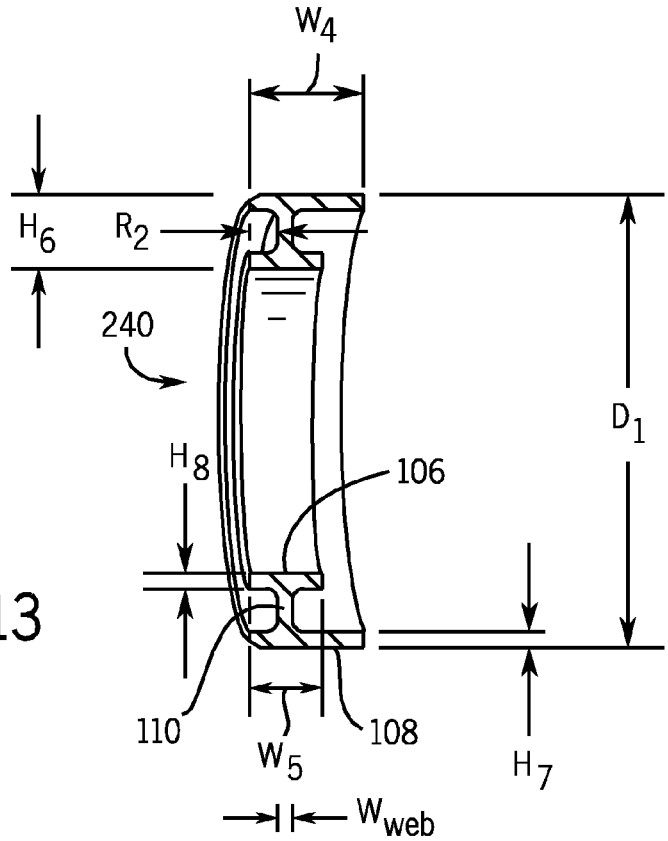

Referring to FIG. 13, an alternative preferred embodiment of the annular member is shown as item number 240. The annular member 240 is substantially the same as the annular member 40, with the exception of its radial cross-sectional shape. The annular member 240 has a radial cross-sectional shape that resembles an I-beam or H-beam. The annular member 240 has a width $W_4$, which is the same as the width W of the annular member 40 and a height, $H_6$. The annular member 240 further includes inner and outer flanges 106 and 108 connected by a web 110 to form the general I or H beam radial cross-sectional shape and define a recess having a depth $R_2$. The inner and outer flanges 106 and 108 have heights (or thicknesses) $H_8$ and $H_7$, respectively. The width of the outer flange 108 is the width $W_4$, and the inner flange 106 has a width $W_5$ that is preferably at least 50 percent of the width $W_4$. Like the first aspect ratio, the aspect ratio of $H_6$ over the width $W_4$ is preferably at least 0.5. Like the third aspect ratio, the aspect ratio of $D_1$ over the width $W_4$ is preferably at least 1.5. In one preferred embodiment, the heights $H_8$ and $H_7$ are substantially equal. In other preferred embodiments, the height $H_5$ and $H_4$ can be greater or less than each other. The recess depth $R_2$ is preferably at least 15 percent of the width $W_3$.

The aspect ratio of the width of the inner flange 106, $W_5$, over the width of the web 110, $W_{web}$, is preferably at least 1.25. In a particularly preferred embodiment, the aspect ratio of the width of the inner flange 106, $W_5$, over the width of the web 110, $W_{web}$, is preferably at least 1.5. Similarly, the aspect ratio of the width of the outer flange 108, $W_4$, over the width of the web 110, $W_{web}$, is preferably at least 1.25, and is more particularly preferred to be at least 1.5. In one particularly preferred embodiment, the annular member 140 is formed of aluminum, has a weight of approximately 0.92 ounce and a stiffness coefficient ($EI/R^3$) of approximately 14,846 lbs/in. In other preferred embodiments, other materials, weights and stiffness coefficients can be used.

Figure 14:
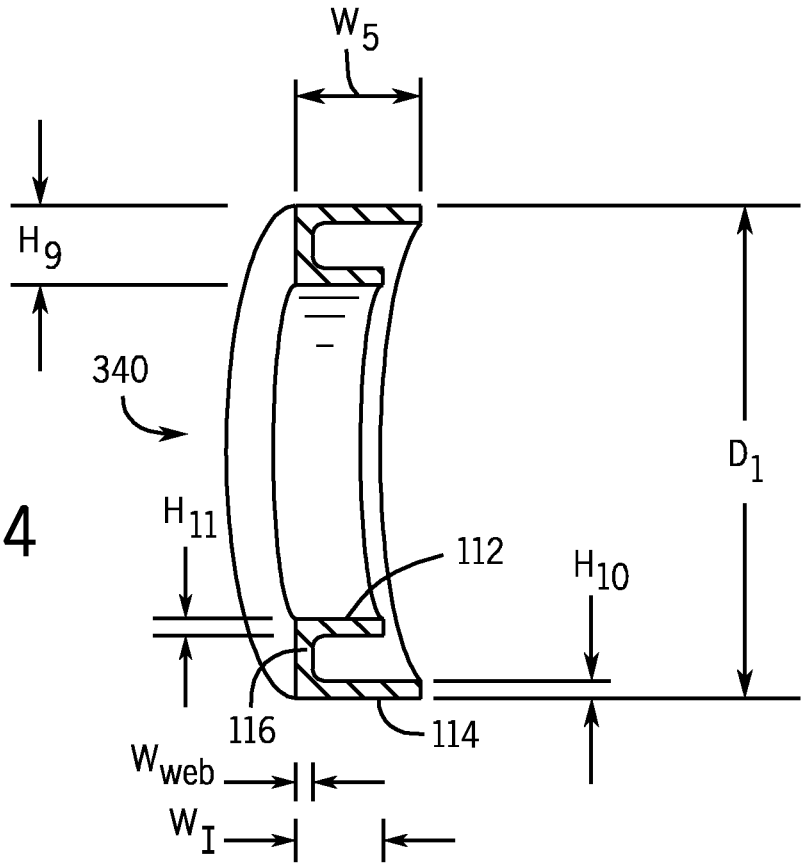

Referring to FIG. 14, an alternative preferred embodiment of the annular member is shown as item number 340. The annular member 340 is substantially the same as the annular member 40, with the exception of its radial cross-sectional shape. The annular member 340 has a C radial cross-sectional shape. The annular member 340 has a width $W_5$, which is the same as the width W of the annular member 40 and a height, $H_9$. The annular member 340 further includes inner and outer flanges 112 and 114 connected by a web 116 to form the C radial cross-sectional shape. The inner and outer flanges 112 and 114 have heights (or thicknesses) $H_{11}$ and $H_{10}$, and widths $W_5$ and $W_I$, respectively. Like the first aspect ratio, the aspect ratio of $H_9$ over the width $W_5$ is preferably at least 0.5. Like the third aspect ratio, the aspect ratio of $D_1$ over the width $W_5$ is preferably at least 1.5. In one preferred embodiment, the heights $H_{11}$ and $H_{10}$ are substantially equal. In other preferred embodiments, the height $H_{11}$ and $H_{10}$ can be greater or less than each other.

The aspect ratio of the width of the inner flange 112, $W_I$, over the width of the web 116, $W_{web}$, is at least 1.25. In a particularly preferred embodiment, the aspect ratio of the width of the inner flange 112, $W_I$, over the width of the web 116, $W_{web}$, is preferably at least 1.5. Similarly, the aspect ratio of the width of the outer flange 114, $W_5$, over the width of the web 116, $W_{web}$, is preferably at least 1.25, and is more particularly preferred to be at least 1.5. In one particularly preferred embodiment, the annular member 340 is formed of aluminum, has a weight of approximately 0.90 ounce and a stiffness coefficient ($EI/R^3$) of approximately 14,668 lbs/in. In other preferred embodiments, other materials, weights and stiffness coefficients can be used, and the sizes of the inner and outer flanges and the web can be varied.

Figure 15:
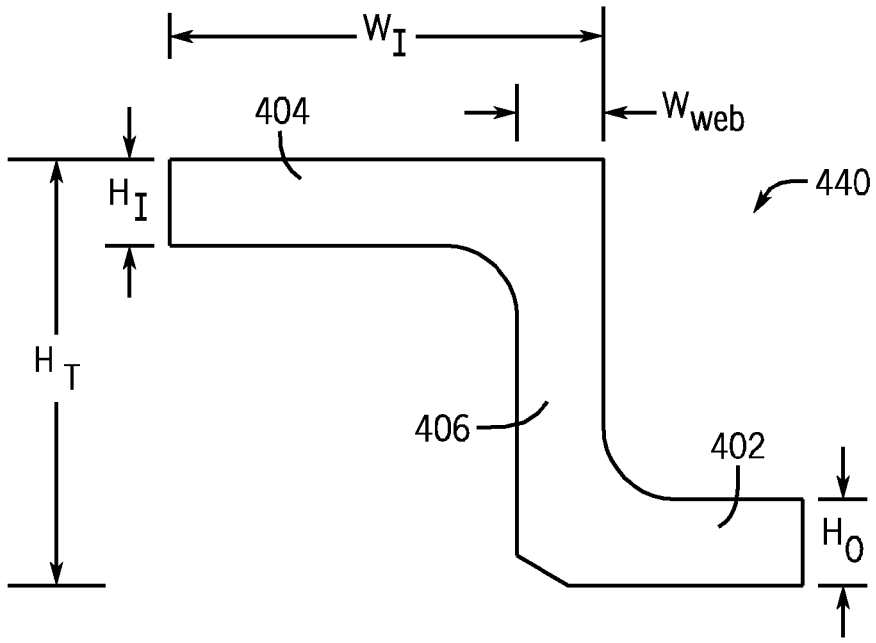
FIGS. 15 through 20 illustrate radial cross-sectional views of annular members in accordance with alternative preferred embodiments of the present invention.

Referring to FIG. 15, an alternative preferred embodiment of the annular member is shown as item number 440. The annular member 440 is substantially the same as the annular member 40, with the exception of its radial cross-sectional shape. The annular member 440 has a generally Z shaped radial cross-sectional shape. The annular member 440 further includes inner and outer flanges 402 and 404 connected by a web 406 to form the generally Z-shaped radial cross-sectional shape. The annular member 440 has a height $H_T$, and the outer and inner flanges 402 and 404 have heights (or thicknesses) $H_O$ and $H_I$, respectively. The inner flange 404 has a width, $W_I$, and the web 406 has a width, $W_{web}$. The aspect ratio of the width of the inner flange 404, $W_I$, over the width of the web 406, $W_{web}$, is at least 1.25. In a particularly preferred embodiment, the aspect ratio of the width of the inner flange 404, $W_I$, over the width of the web 406, $W_{web}$, is preferably at least 1.5. In one particularly preferred embodiment, the annular member 440 is formed of aluminum, has a weight of approximately 0.6337 ounce and a stiffness coefficient ($EI/R^3$) of approximately 11,252.4 lbs/in. In other preferred embodiments, other materials, weights and stiffness coefficients can be used, and the sizes of the inner and outer flanges and the web can be varied.

Figure 16:
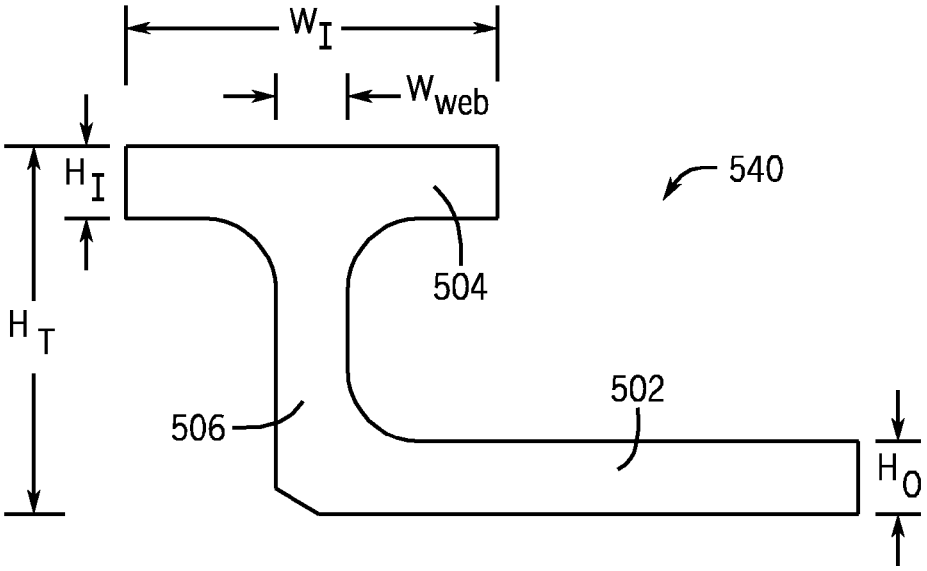

Referring to FIG. 16, an alternative preferred embodiment of the annular member is shown as item number 540. The annular member 540 is substantially the same as the annular member 40, with the exception of its radial cross-sectional shape. The annular member 540 has a generally T shaped radial cross-sectional shape. The annular member 540 further includes inner and outer flanges 502 and 504 connected by a web 506 to form the generally T-shaped radial cross-sectional shape. The annular member 540 has a height $H_T$, and the outer and inner flanges 502 and 504 have heights (or thicknesses) $H_O$ and $H_I$, respectively. The inner flange 504 has a width, $W_I$, and the web 506 has a width, $W_{web}$. The aspect ratio of the width of the inner flange 504, $W_I$, over the width of the web 506, $W_{web}$, is at least 1.25. In a particularly preferred embodiment, the aspect ratio of the width of the inner flange 504, $W_I$, over the width of the web 506, $W_{web}$, is preferably at least 1.5. In one particularly preferred embodiment, the annular member 540 is formed of aluminum, has a weight of approximately 0.9317 ounce and a stiffness coefficient ($EI/R^3$) of approximately 14,813.6 lbs/in. In other preferred embodiments, other materials, weights and stiffness coefficients can be used, and the sizes of the inner and outer flanges and the web can be varied.

Figure 17:
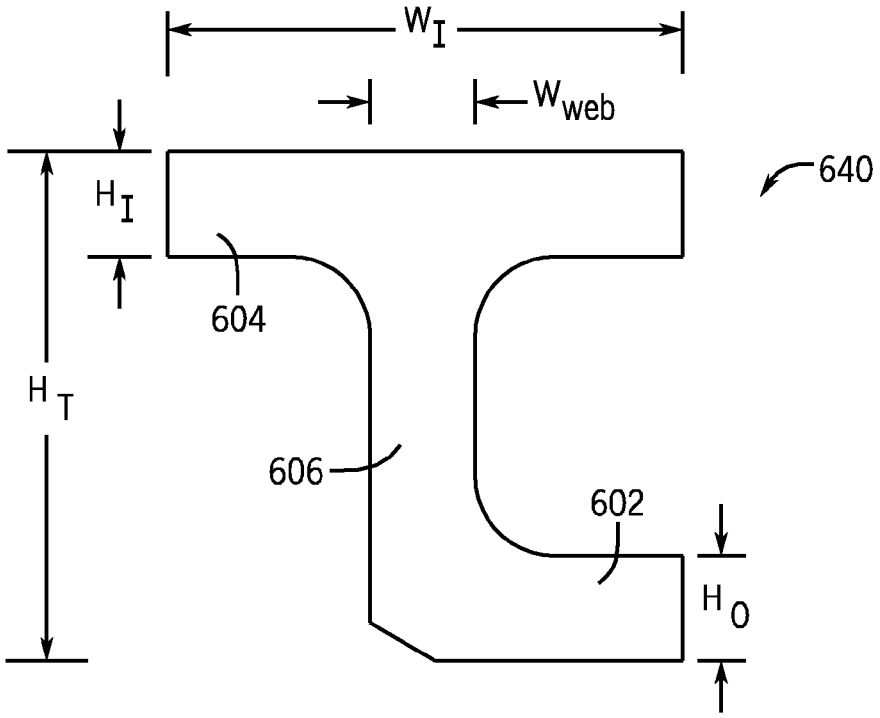

Referring to FIG. 17, an alternative preferred embodiment of the annular member is shown as item number 640. The annular member 640 is substantially the same as the annular member 40, with the exception of its radial cross-sectional shape. The annular member 640 has a generally T shaped radial cross-sectional shape. The annular member 640 further includes inner and outer flanges 602 and 604 connected by a web 606 to form the generally T-shaped radial cross-sectional shape. The annular member 640 has a height $H_T$, and the outer and inner flanges 602 and 604 have heights (or thicknesses) $H_o$ and $H_I$, respectively. The inner flange 604 has a width, $W_I$, and the web 606 has a width, $W_{web}$. The aspect ratio of the width of the inner flange 604, $W_I$, over the width of the is web 606, $W_{web}$, is at least 1.25. In a particularly preferred embodiment, the aspect ratio of the width of the inner flange 604, $W_I$, over the width of the web 606, $W_{web}$, is preferably at least 1.5. In one particularly preferred embodiment, the annular member 640 is formed of aluminum, has a weight of approximately 0.6196 ounce and a stiffness coefficient ($EI/R^3$) of approximately 10,884.5 lbs/in. In other preferred embodiments, other materials, weights and stiffness coefficients can be used, and the sizes of the inner and outer flanges and the web can be varied.

Figure 18:
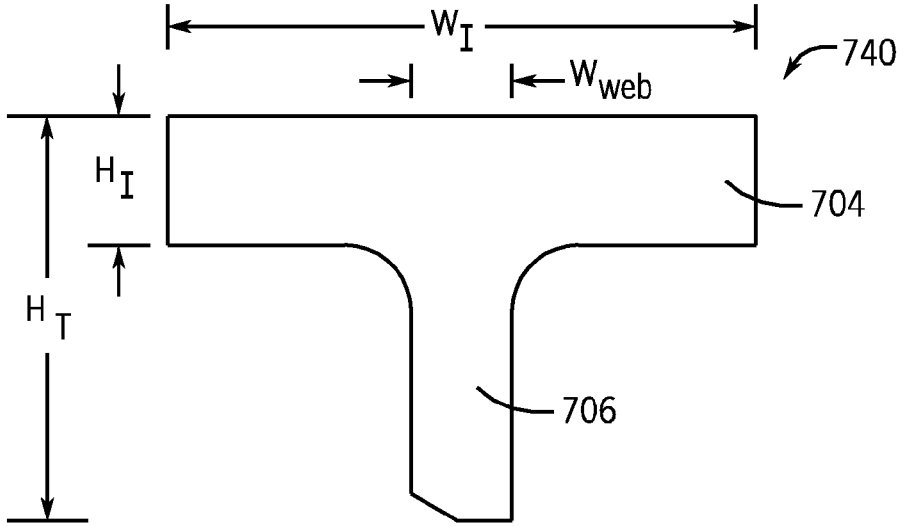

Referring to FIG. 18, an alternative preferred embodiment of the annular member is shown as item number 740. The annular member 740 is substantially the same as the annular member 40, with the exception of its radial cross-sectional shape. The annular member 740 has a T radial cross-sectional shape. The annular member 740 further includes an inner flange 704 connected to a web 706 to form the T radial cross-sectional shape. The annular member 740 has a height $H_T$, and the inner flange 704 has a height (or thicknesses) $H_I$. The inner flange 704 has a width, $W_I$, and the web 706 has a width, $W_{web}$. The aspect ratio of the width of the inner flange 704, $W_I$, over the width of the web 706, $W_{web}$, is at least 1.25. In a particularly preferred embodiment, the aspect ratio of the width of the inner flange 704, $W_I$, over the width of the web 706, $W_{web}$, is preferably at least 1.5. In one particularly preferred embodiment, the annular member 740 is formed of aluminum, has a weight of approximately 0.9223 ounce and a stiffness coefficient ($EI/R^3$) of approximately 13,655.0 lbs/in. In other preferred embodiments, other materials, weights and stiffness coefficients can be used, and the sizes of the inner and outer flanges and the web can be varied.

Figure 19:
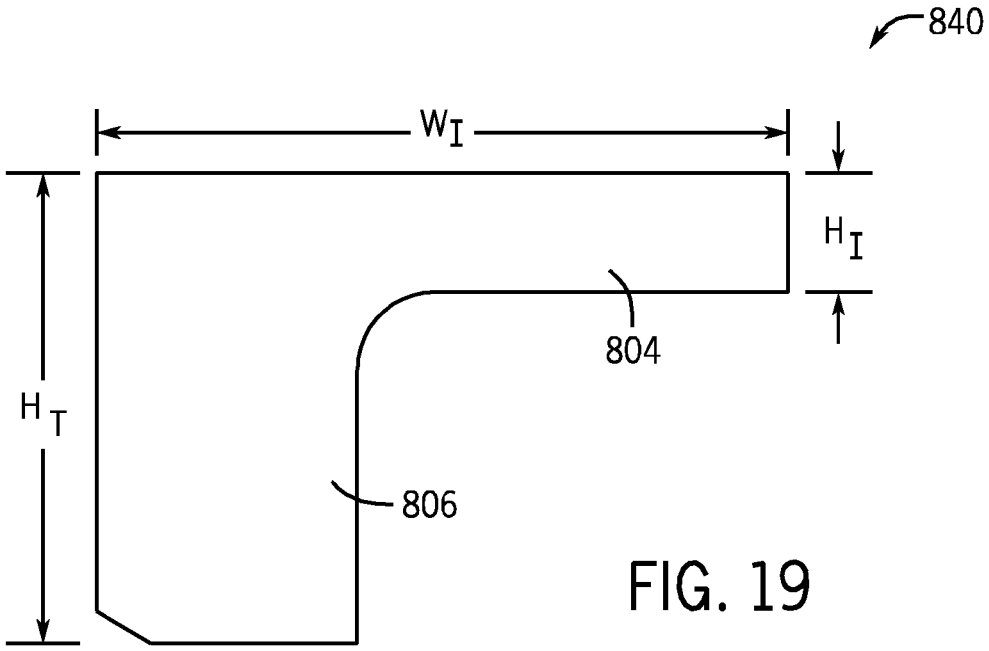

Referring to FIG. 19, an alternative preferred embodiment of the annular member is shown as item number 840. The annular member 840 is substantially the same as the annular member 40, with the exception of its radial cross-sectional shape. The annular member 840 has a reversed L radial cross-sectional shape. The annular member 840 further includes an inner flange 804 connected to a web 806 to form the reversed L radial cross-sectional shape. The annular member 840 has a height $H_T$, and the inner flange 804 has a height (or thicknesses) $H_I$. The inner flange 804 has a width, $W_I$, and the web 806 has a width, $W_{web}$. The aspect ratio of the width of the inner flange 804, $W_I$, over the width of the web 806, $W_{web}$, is at least 1.25. In a particularly preferred embodiment, the aspect ratio of the width of the inner flange 804, $W_I$, over the width of the web 806, $W_{web}$, is preferably at least 1.5. In one particularly preferred embodiment, the annular member 840 is formed of aluminum, has a weight of approximately 1.1749 ounce and a stiffness coefficient ($EI/R^3$) of approximately 20,645.2 lbs/in. In other preferred embodiments, other materials, weights and stiffness coefficients can be used, and the sizes of the inner and outer flanges and the web can be varied.

Figure 20:
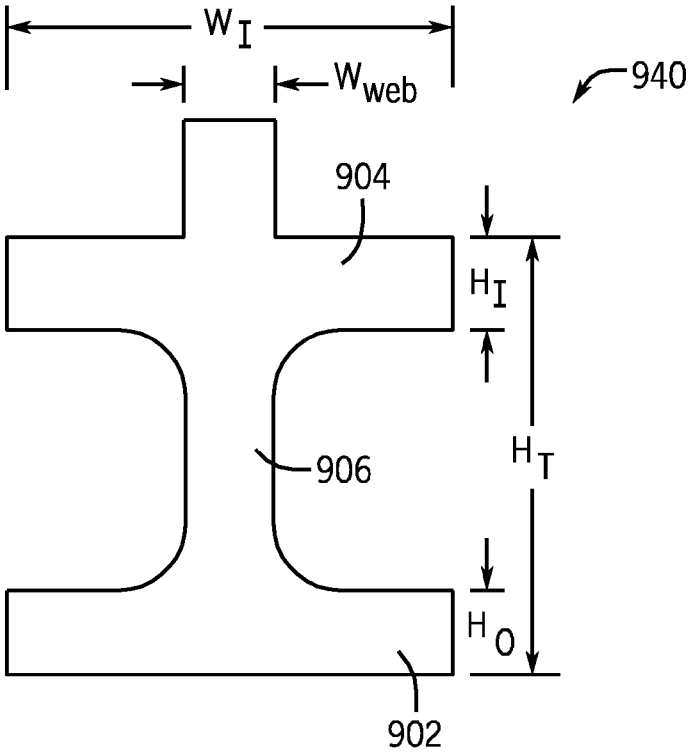

Referring to FIG. 20, an alternative preferred embodiment of the annular member is shown as item number 940. The annular member 940 is substantially the same as the annular member 40, with the exception of its radial cross-sectional shape. The annular member 940 has a generally I shaped radial cross-sectional shape. The annular member 940 further includes inner and outer flanges 902 and 904 connected by a web 906 to form the generally I-shaped radial cross-sectional shape. The annular member 940 has a height $H_T$, and the outer and inner flanges 902 and 904 have heights (or thicknesses) $H_O$ and $H_I$, respectively.

The inner flange 904 has a width, $W_I$, and the web 906 has a width, $W_{web}$. The aspect ratio of the width of the inner flange 904, $W_I$, over the width of the web 906, $W_{web}$, is at least 1.25. In a particularly preferred embodiment, the aspect ratio of the width of the inner flange 904, $W_I$, over the width of the web 906, $W_{web}$, is preferably at least 1.5. Similarly, the aspect ratio of the width of the outer flange 902, also $W_I$, over the width of the web 906, $W_{web}$, is preferably at least 1.25, and is more particularly preferred to be at least 1.5. In one particularly preferred embodiment, the annular member 940 is formed of aluminum, has a weight of approximately 0.8076 ounce and a stiffness coefficient ($EI/R^3$) of approximately 18,003.2 lbs/in. In other preferred embodiments, other materials, weights and stiffness coefficients can be used, and the sizes of the inner and outer flanges and the web can be varied.

The radial cross-sectional shapes of the annular members 140 through 940 and their size enable the annular member to have a desirable low weight and a desirable high level of stiffness. The annular members 140 through 940, like the annular member 40, each have a weight preferably within the range of 0.4 to 1.85 ounces, and more particularly preferred within the range of 0.65 to 1.3 ounces. The annular members 140 through 940 also each have a hoop stiffness as indicated by a stiffness coefficient of within the range of 9,000 to 39,000 lbs/in. In a particularly preferred embodiment, the annular member 40 has a stiffness coefficient within the range of 12,000 to 18,000 lbs/in. The annular members 140 through 940 can be formed of the same material or materials as the annular member 40.

Some ball bat insert configurations can produce a dead sound when the barrel portion impacts a ball during use. The annular members provide a region of concentrated stiffness to the barrel portion 18 of the bat. In some configurations, a region of concentrated stiffness can produce a deadened sound upon impact with a game ball. The annular members 140 through 940 and annular members of similar constructions can provide the benefit of an improved sound upon impact with a game ball. The incorporation of the web and the inner flange of the annular members 140 through 940 serves to improve the sound the barrel portion 18 makes upon impact with a ball.

The annular member can be formed of different widths, heights, radial cross-sectional areas (or shapes) and materials. Table 1 below provides several different annular member configurations contemplated under the present invention. Annular member specimens 10 thru 25 below include stiffness coefficients ($EI/R^3$) within the particularly preferred range of 12,000 to 18,000 lbs/in. Similarly, all but annular member specimen nos. 2, 33, 39 and 40 have a weight within the preferred range of 0.4 to 1.85 ounces, and annular member specimen numbers 5, 8-11, 13-27, 30-32, 34 and 35 have a weight within the particularly preferred range of 0.65 to 1.3 ounces. The annular member specimens having weights greater than the preferred upper range of 1.5 ounces can have the undesirable effect of increasing the MOI beyond of the bat beyond desirable levels, and thereby rendering the bat less suitable for competitive play. The annular member specimen nos. 6, 7, 11, 15, 17, 18, 20, 23, 25 and 30 are configured in the shape of FIGS. 17, 15, 5, 18, 16, 14, 13, 12 and 20, respectively. Different annular member shapes can result in a different sound coming off the bat during use when installed into a barrel portion of the bat. The annular members are configured to provide concentrated stiffness to the barrel portion of the bat. The annular member can be optimized for a particular application, performance criteria or player.

TABLE 1

ANNULAR MEMBER CONFIGURATIONS
E (aluminum) = 10,000,000 lbs/in$^2$ E (magnesium) = 6,500,000 lbs/in$^2$

| Annular Member Specimen No. | Section Shape | Material | I (in$^4$) | A(in$^2$) | R (centroid) (in) | Weight (oz) | EI | Stiffness Coefficient $EI/R^3$ (lbs/in) |
|---|---|---|---|---|---|---|---|---|
| 1 | Rectangle 1 | al | 0.000374 | 0.165000 | 1.095000 | 1.8373 | 3740.0 | 2848.6 |
| 2 | Rectangle 2 | al | 0.000457 | 0.038000 | 0.987500 | 0.3816 | 4570.0 | 4745.8 |
| 3 | Rectangle 3 | al | 0.000891 | 0.080300 | 0.995000 | 0.8125 | 8910.0 | 9045.0 |
| 4 | I-beam 1 | mg | 0.001564 | 0.088858 | 1.017523 | 0.5582 | 10166.0 | 9649.8 |
| 5 | I-beam 2 | mg | 0.001636 | 0.105358 | 1.014387 | 0.6599 | 10634.0 | 10187.9 |
| 6 | T-shaped (FIG. 17) | al | 0.000982 | 0.063055 | 0.966275 | 0.6196 | 9820.0 | 10884.5 |
| 7 | Z-shaped (FIG. 15) | al | 0.001034 | 0.064092 | 0.972205 | 0.6337 | 10340.0 | 11252.4 |
| 8 | I-beam 3 | mg | 0.001783 | 0.110983 | 1.006055 | 0.6894 | 11589.5 | 11381.5 |
| 9 | Rectangle 4 | al | 0.001143 | 0.095000 | 0.987500 | 0.9540 | 11430.0 | 11869.6 |
| 10 | I-beam 5 | mg | 0.001855 | 0.118483 | 0.999696 | 0.7313 | 12057.5 | 12068.5 |
| 11 | L-shaped 1 (FIG. 5) | al | 0.001332 | 0.109133 | 1.032036 | 1.1454 | 13320.0 | 12117.7 |
| 12 | I-beam 6 | mg | 0.001926 | 0.088553 | 0.996682 | 0.5449 | 12519.0 | 12644.4 |
| 13 | I-beam 7 | mg | 0.002021 | 0.109858 | 1.000437 | 0.6786 | 13136.5 | 13119.3 |
| 14 | Triangle 1 | al | 0.001437 | 0.122208 | 1.024141 | 1.2728 | 14370.0 | 13377.6 |
| 15 | T-shaped 2 (FIG. 18) | al | 0.000986 | 0.101092 | 0.897144 | 0.9223 | 9860.0 | 13655.0 |
| 16 | L-shaped 2 | mg | 0.002250 | 0.125083 | 0.999420 | 0.7718 | 14625.0 | 14650.5 |
| 17 | T-shaped 3 (FIG. 16) | al | 0.001564 | 0.089980 | 1.018259 | 0.9317 | 15640.0 | 14813.6 |
| 18 | C-shape 1 (FIG. 14) | al | 0.001547 | 0.087182 | 1.017908 | 0.9025 | 15470.0 | 14667.8 |
| 19 | Rectangle 5 | al | 0.001308 | 0.082031 | 0.958750 | 0.7998 | 13080.0 | 14842.0 |
| 20 | I-beam 8 (FIG. 13) | al | 0.001564 | 0.088858 | 1.017523 | 0.9195 | 15640.0 | 14845.8 |
| 21 | L-shaped 3 | al | 0.001737 | 0.116833 | 1.016414 | 1.2076 | 17370.0 | 16542.0 |
| 22 | I-beam 9 | al | 0.001640 | 0.078132 | 0.984455 | 0.7822 | 16400.0 | 17189.2 |
| 23 | I-beam 10 (FIG. 12) | mg | 0.002507 | 0.127703 | 0.980000 | 0.7727 | 16295.5 | 17313.7 |

TABLE 1-continued

ANNULAR MEMBER CONFIGURATIONS
E (aluminum) = 10,000,000 lbs/in$^2$ E (magnesium) = 6,500,000 lbs/in$^2$

| Annular Member Specimen No. | Section Shape | Material | I (in$^4$) | A(in$^2$) | R (centroid) (in) | Weight (oz) | EI | Stiffness Coefficient EI/R$^3$ (lbs/in) |
|---|---|---|---|---|---|---|---|---|
| 24 | Rectangle 6 | al | 0.001535 | 0.096250 | 0.958750 | 0.9384 | 15350.0 | 17417.8 |
| 25 | I-beam 11 (FIG. 20) | al | 0.001652 | 0.081725 | 0.971748 | 0.8076 | 16520.0 | 18003.2 |
| 26 | I-beam 12 | al | 0.001848 | 0.088192 | 0.983091 | 0.8817 | 18480.0 | 19450.1 |
| 27 | I-beam 13 | al | 0.001926 | 0.088553 | 0.996682 | 0.8975 | 19260.0 | 19453.0 |
| 28 | Round 1 | al | 0.001798 | 0.150330 | 0.958750 | 1.4657 | 17980.0 | 20402.0 |
| 29 | Triangle 2 | al | 0.002099 | 0.147682 | 1.008914 | 1.5152 | 20990.0 | 20438.5 |
| 30 | Reverse L-shape (FIG. 19) | al | 0.001688 | 0.123554 | 0.935085 | 1.1749 | 16880.0 | 20645.2 |
| 31 | L-shaped 4 | al | 0.002250 | 0.125083 | 0.999420 | 1.2713 | 22500.0 | 22539.2 |
| 32 | L-shaped 5 | mg | 0.003301 | 0.138833 | 0.970632 | 0.8320 | 21456.5 | 23463.6 |
| 33 | Rectangle 7 | al | 0.002670 | 0.221920 | 0.987500 | 2.2286 | 26700.0 | 27726.8 |
| 34 | Rectangle 8 | al | 0.002292 | 0.110000 | 0.927500 | 1.0375 | 22920.0 | 28725.8 |
| 35 | L-shaped 6 | mg | 0.004622 | 0.152583 | 0.941400 | 0.8869 | 30043.0 | 36009.8 |
| 36 | L-shaped 7 | al | 0.003301 | 0.138833 | 0.970632 | 1.3704 | 33010.0 | 36097.9 |
| 37 | Round 2 | al | 0.003068 | 0.196350 | 0.927500 | 1.8520 | 30679.6 | 38451.0 |
| 38 | L-shaped 8 | al | 0.004622 | 0.152583 | 0.941400 | 1.4607 | 46220.0 | 55399.7 |
| 39 | Rectangle 9 | al | 0.006859 | 0.570000 | 0.987500 | 5.7241 | 68590.0 | 71227.8 |
| 40 | Rectangle 10 | al | 0.009145 | 0.760000 | 0.987500 | 7.6321 | 91453.3 | 94970.4 |

Figure 21:
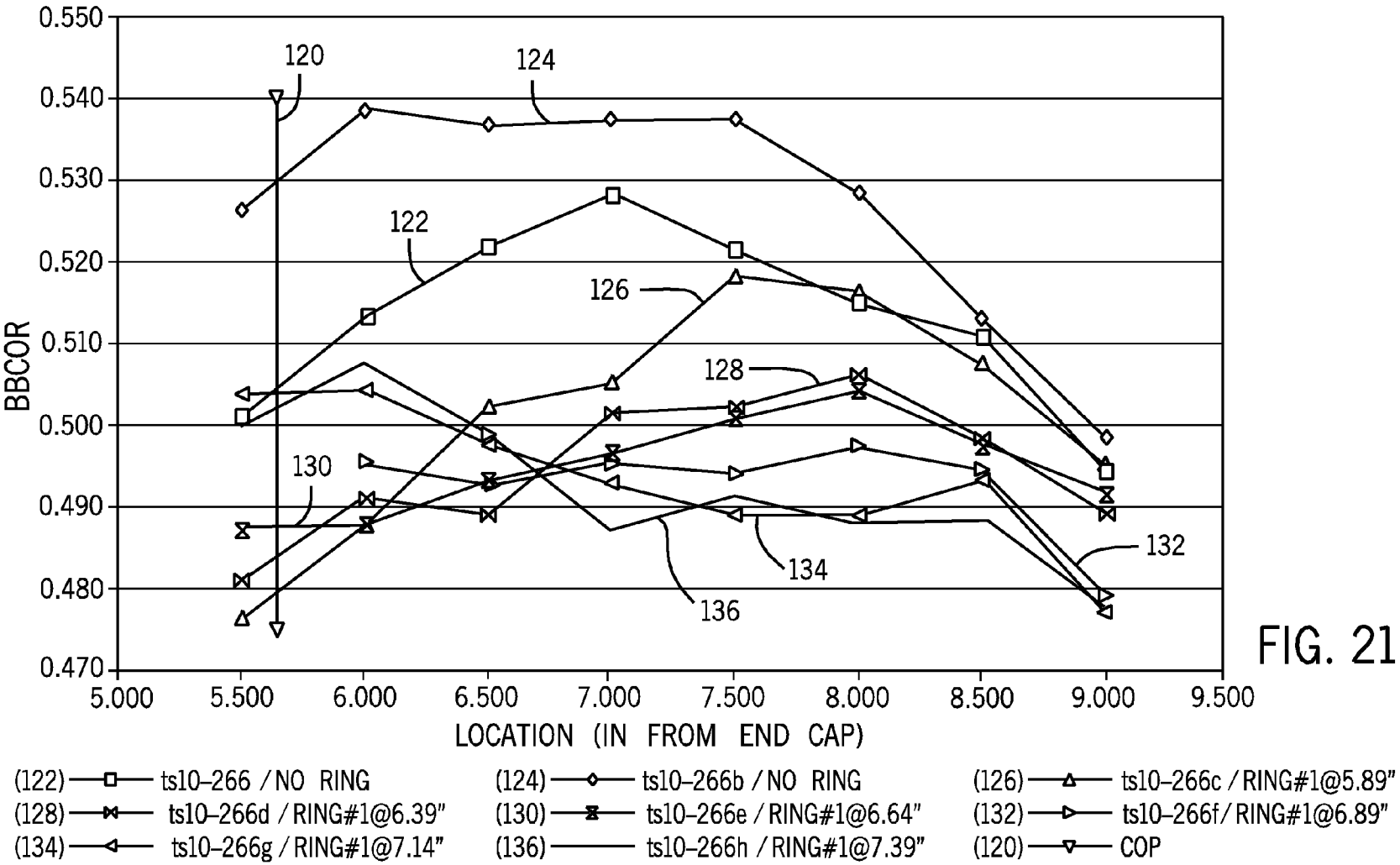
FIGS. 21 and 22 are graphs illustrating BBCOR performance values taken at different distances along the barrel portion of ball bats with and without an annular member.

Referring to FIG. 21, a graphical representation of bat performance is illustrated for a baseball bat (specimen number ts10-266) with and without an annular member (the annular member 240 of FIG. 13) positioned within the barrel portion of the bat at different positions. The bat used for the data of FIG. 21 is a thirty three inch long baseball bat having a weight of 30 ounces, an aluminum barrel portion and a separate handle portion formed of a fiber composite material. The x-axis of the graph of FIG. 21 represents the distance from the end cap 38 of the bat 10 and the y-axis represents the BBCOR value from the BBCOR test protocol. The vertical line 120 on the graph represents the location of the COP of the bat 10. The COP for the bat 10 of FIG. 21 is located at approximately 5.7 inches from the end cap 38 of the bat 10. FIG. 21 illustrates seven data lines (Lines 122-136) representing separate BBCOR performance profiles performed on the bat. Each line shows BBCOR values taken from different locations about the barrel portion from the end cap 38 of the bat 10. The NCAA BBCOR Standard requires a baseball bat to have a BBCOR less than or equal to 0.500.

Data line 122 is taken on the bat 10 without an annular member and without any ring machining on the inner surface 30 of the barrel portion 18. The barrel portion 18 of the bat 10 of line 22 has a tabletop configuration (e.g. FIG. 9). The data line 122 illustrates that BBCOR test readings at multiple points along the length of the barrel portion 18 (5.5 inches through 8.5 inches) resulted in BBCOR values above the 0.500 limit. Accordingly, the bat of data line 122 would not satisfy the BBCOR limit of 0.500.

Data line 124 represents BBCOR test readings on the same bat 10 of data line 122 without an annular member, but with ring machining applied to the inner surface 30 of the barrel portion 18. The ring machining forms the second set of projections 50 into the inner surface 30. The machining of the second set of projections 50 results in the removal of some material from the tabletop configuration of the barrel portion 18 thereby slightly reducing the wall thickness of the barrel portion 18. The data line 124 illustrates that BBCOR test readings at multiple points along the length of the barrel portion 18 (5.5 inches through 8.5 inches) resulted in BBCOR values above the 0.500 limit. Accordingly, the bat of data line 124 would not satisfy the BBCOR limit of 0.500. The BBCOR values are higher than the BBCOR values of the data line 122 due to the slightly reduced wall thickness of the barrel portion 18 following the ring machining and application of the second set of projections 50.

Data lines 126 through 136 represent BBCOR performance profiles obtained on the same bat as the data line 124, but with the annular member 240 positioned at different positions within the barrel portion 18 of the bat 10. Data line 126 is taken with the center of mass of the annular member 240 positioned approximately 5.89 inches away from the end cap 38 to the centroid of the annular member 240. Data lines 128, 130, 132, 134 and 136 are taken with the center of mass of the annular member 240 positioned at approximately 6.39 inches, 6.64 inches, 6.89 inches, 7.14 inches and 7.39 inches from the end cap 38, respectively, to the centroid of the annular member 240. The BBCOR values of the data lines 128 through 136 generally show a gradual reduction in many BBCOR values as the position of the annular member 240 is positioned further from the COP 120 toward the handle portion 16 of the bat 10.

Data line 132 results in all BBCOR values positioned below the 0.500 limit. The data line 132 also provides a more uniform consistent BBCOR value across the length of the barrel portion (from 6.0 inches through 8.5 inches). Accordingly, the bat 10 of data line 132 would satisfy the BBCOR performance limit of 0.500 and will provide a wide area of consistent performance along the length of the barrel portion of the bat. The annular member 240 is positioned with its center of mass at approximately 6.89 inches from the end cap 38 to the centroid of the annular member 240, and approximately 1.19 inches away or spaced apart from the COP 120.

Lines 126 through 132 demonstrate that by positioning (longitudinally spacing) the annular member 240 further from the COP of the baseball bat, the maximum BBCOR values of the bat drop. Further, the BBCOR readings across the barrel portion become more uniform thereby making the performance of the barrel portion more consistent and responsive over a greater portion of the hitting area or hitting surface of the barrel portion of the bat.

Figure 22:
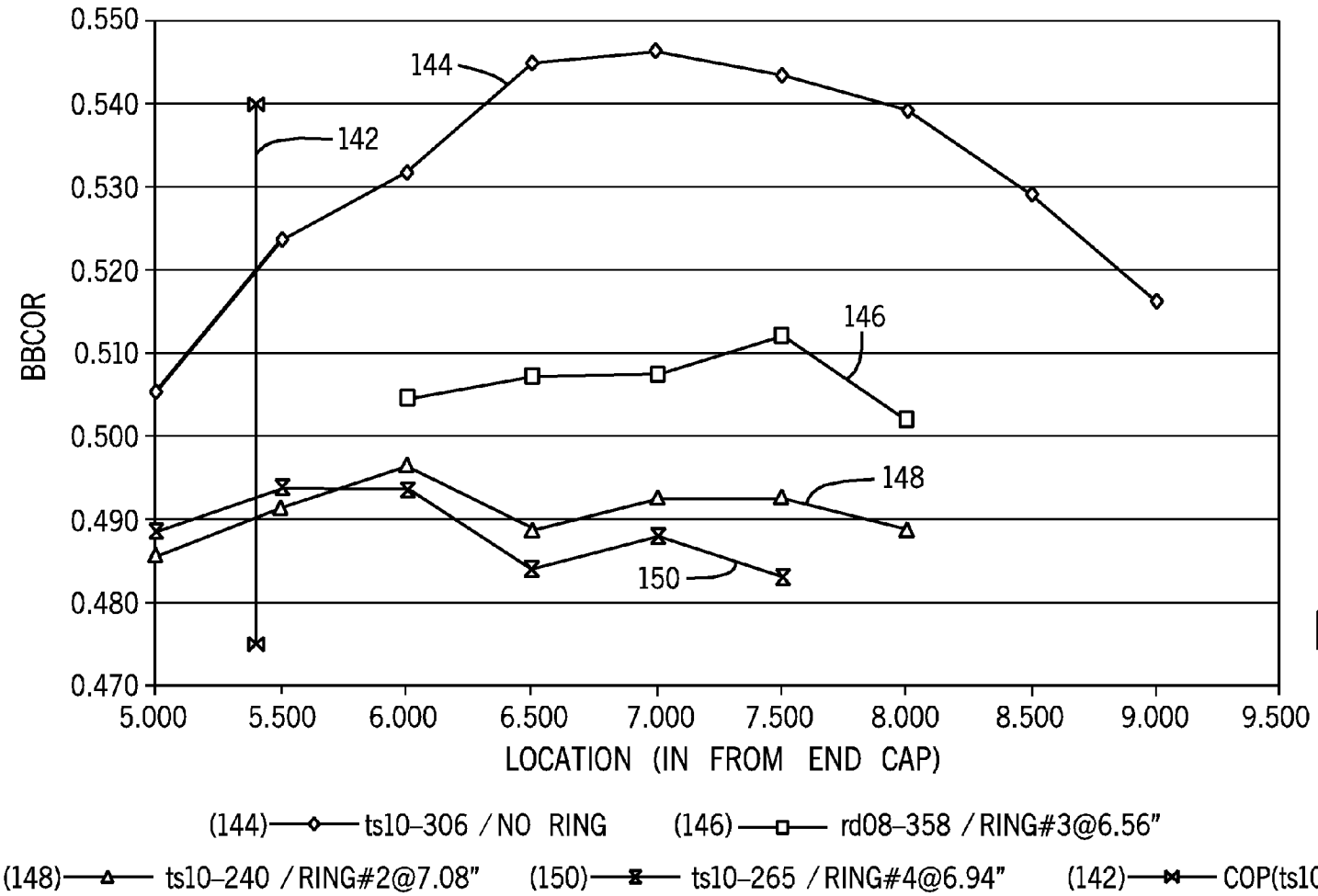

Referring to FIG. 22, a graphical representation of bat performance is illustrated for four separate baseball bat configurations. Like FIG. 21, the x-axis represents the distance from the end cap 28 and the y-axis represents the BBCOR value from the BBCOR test protocol. The bat 10 of data line 144 (bat specimen ts10-306) is similar to the bat 10, ts10-266 of FIG. 21, with the exception of the barrel portion 18 being formed without a table top configuration. The bat of data line 144 includes no annular member. The data line 144 illustrates that BBCOR test readings at multiple points along the length of the barrel portion 18 (5.5 inches through 9.0 inches) resulted in BBCOR values above the 0.500 limit. Accordingly, the bat of data line 144 would not satisfy the BBCOR limit of 0.500. The vertical line 142 on the graph represents the location of the COP of the bat 10 (specimen is 10-240). The COP 142 is located at approximately 5.4 inches from the end cap 38 of the bat 10.

Data line 146 illustrates a BBCOR performance profile for a bat 10 (specimen rd08-358) including an annular member that is similar to the Annular Member Specimen No. 1 of Table 1 positioned within the barrel portion 18 at a location 6.56 inches inward from the end cap 38 of the bat 10. The bat of specimen no. rd08-358 is a bat having a length of 33 inches and a weight of 30 ounces and includes an aluminum barrel portion and a separate handle portion formed of a fiber composite material. The annular member has a rectangular radial cross-sectional area. The BBCOR performance profile is generally consistent, but just slightly above the BBCOR limit of 0.500.

Data lines 148 and 150 illustrate BBCOR performance profiles of two separate bats 10, specimen nos. ts10-240 and is 10-265, respectively. The specimens ts10-240 and ts10-265 are different bats each having a length of 33 inches and a weight of 30 inches with an aluminum barrel portion and a separate handle portion formed of a fiber composite material. Data line 148 and bat specimen ts10-240 includes the annular member 140 of FIG. 12 positioned at approximately 7.08 inches from the end cap 38 of the bat. Data line 150 and bat specimen ts10-265 includes the annular member 40 of FIG. 5 positioned at approximately 6.94 inches from the end cap 38 of the bat. Both data lines 148 and 150 illustrate BBCOR performance that is below the 0.500 limit. Accordingly, each of the bats of data lines 148 and 150 satisfy the BBCOR limit of 0.500. The data lines 148 and 150 also illustrate generally consistent BBCOR performance over the length of the bat 10.

As shown in FIGS. 21 and 22 and data lines 132, 148 and 150, the most desirable BBCOR performance profiles do not occur with the annular member positioned at the COP of the bat. Rather, the most desirable location of the annular member is a location spaced apart from the COP.

Figure 23:
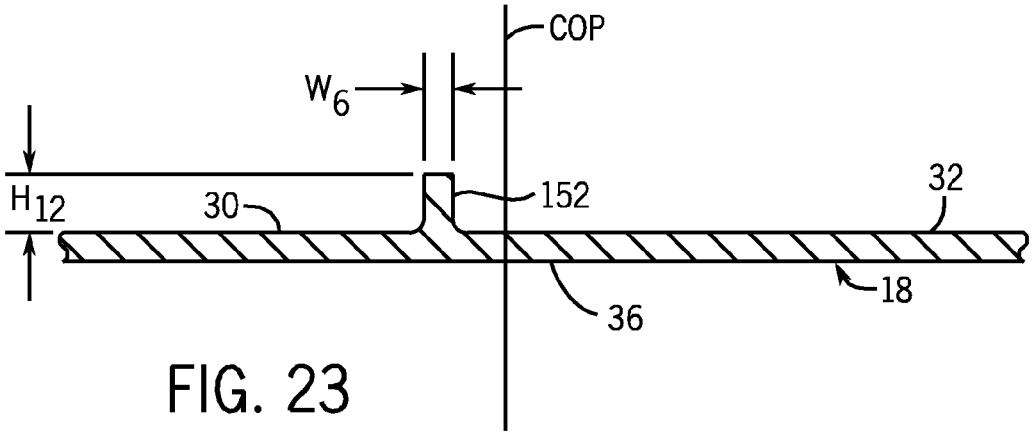
FIGS. 23 and 24 are longitudinal sectional views of barrel portions in accordance with alternative preferred embodiments of the present invention.
Figure 24:
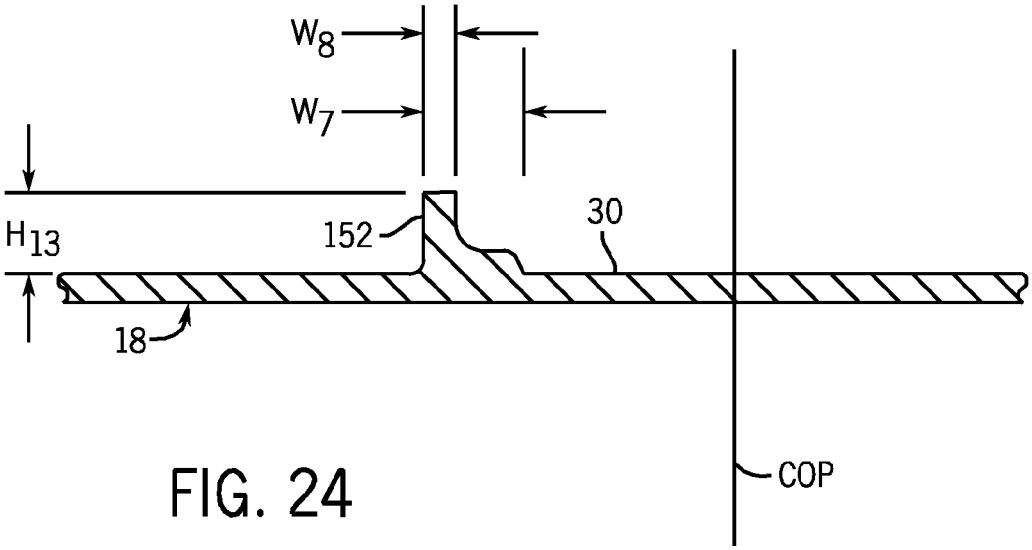

Referring to FIGS. 23 and 24, in alternative preferred embodiments, the barrel portion 18 of the bat 10 can be formed with a stiffening region 152 to provide similar performance adjusting effects as that produced by the annular member positioned within a barrel portion without the stiffening region. Accordingly, the stiffening region 152 is formed as part of the barrel portion 18 and is preferably formed of the same materials as the barrel portion 18. The stiffening region 152 projects inwardly and forms a ring of additional material within the bat 10. The height $H_{12}$ (FIG. 23) or $H_{13}$ (FIG. 24) of the stiffening region 152 can be measured from the inner surface 30 of the barrel portion 18 to the maximum inward extent of the stiffening region. The height of the stiffening region 152 can be relatively constant over its width as illustrated in FIG. 23 with width $W_6$, or the height of the stiffening region 152 can vary over its width as shown in FIG. 24 with width $W_7$ and $W_8$. The center of mass of the material forming the stiffening member 152 is preferably longitudinally spaced by at least 0.25 inches from the COP of the bat 10. The height ($H_{12}$ or $H_{13}$) is preferably at least twice the thickness of the average wall thickness of the barrel portion 18 away from the stiffening region 152. The mass of the inner region 152 extending inwardly beyond the inner surface 30 of the barrel portion 18 preferably results in an increase of the moment of inertia of the bat by no more than twenty percent. The maximum height of the stiffening region 152 ($H_{12}$ or $H_{13}$) over the width of the stiffening region ($W_6$ or $W_8$) produces an aspect ratio of at least 0.5. Accordingly, the stiffening region 152 can produce similar beneficial performance characteristics as those produced by a bat having an annular member in its barrel portion without a stiffening region.

The bat 10 of the present invention provides numerous advantages over existing ball bats. One such advantage is that the bat 10 of the present invention is configured for competitive, organized baseball or softball. For example, embodiments of ball bats built in accordance with the present invention can fully meet the bat standards and/or requirements of one or more of the following baseball and softball organizations: Amateur Softball Association of America ("ASA") Bat Testing and Certification Program Requirements (including the current ASA 2004 Bat Standard and the ASA 2000 Bat Standard); United States Specialty Sports Association ("USSSA") Bat Performance Standards for baseball and softball; International Softball Federation ("ISF") Bat Certification Standards; National Softball Association ("NSA") Bat Standards; Independent Softball Association ("ISA") Bat Requirements; Ball Exit Speed Ratio ("BESR") Certification Requirements of the National Federation of State High School Associations ("NFHS"); Little League Baseball Bat Equipment Evaluation Requirements; PONY Baseball/Softball Bat Requirements; Babe Ruth League Baseball Bat Requirements; American Amateur Baseball Congress ("AABC") Baseball Bat Requirements; and, especially, the NCAA BBCOR Standard or Protocol. Accordingly, the term "bat configured for organized, competitive play" refers to a bat that fully meets the ball bat standards and/or requirements of, and is fully functional for play in, one or more of the above listed organizations.

Further, bats produced in accordance with the present invention can be configured to fully satisfy the BBCOR Standard while providing players with a bat that is reliable, playable, produces exceptional feel and optimizes performance along the barrel portion or hitting portion of the bat. Bats produced in accordance with the present invention can also be configured to meet the NCAA BESR Standard, Bat Performance Factor requirements and other Industry standards and limits. Bats produced in accordance with the present invention are configured to be durable and reliable and are not prone to failure and shattering during normal use. The present invention also allows for bats to be produced in the same or similar manner as they were in the past. The addition of the annular member to a bat construction can take a bat construction from one that does not satisfy the BBCOR Standard to one that does satisfy the BBCOR Standard.

While the preferred embodiments of the invention have been illustrated and described, it will be appreciated that various changes can be made therein without departing from the spirit and scope of the invention. For example, the wall thickness of the barrel portion of the bat can be adjusted or varied to accentuate or fine tune the performance of the bat in association with the annular member. Accordingly, it will be intended to include all such alternatives, modifications and variations set forth within the spirit and scope of the appended claims.

What is claimed is:

1. A ball bat extending about a longitudinal axis, the bat comprising:

a bat frame having a handle portion and a tubular barrel portion, the bat having a proximal end, a distal end, a center of percussion and a length of at least thirty inches, the barrel portion having an inner surface, at least a portion of the inner surface of the barrel portion including a first set of projections;

a knob coupled to the handle portion, and an end cap coupled to the distal end of the barrel portion, the first set of projections being spaced apart from the end cap and defining a first length; and an annular member including an outer radial surface having a second set of projections, the second set of projections defining a second length that is smaller than the first length, the annular member positioned within the barrel portion such that the first set of projections engages the second set of projections to inhibit longitudinal movement of the annular member with respect to the barrel portion in at least one direction, at least one of the projections of the first set of projection and the second set of projection including a leading edge and a trailing edge, wherein the leading edge is sharper than the trailing edge.

2. The ball bat of claim 1, wherein the annular member has a center of mass that is longitudinally spaced apart from the center of percussion of the bat by a first distance, and wherein the first distance being at least 0.25 inch.

3. The ball bat of claim 2, wherein the first distance being at least 0.5 inch.

4. The ball bat of claim 1, wherein the annular member increases the moment of inertia of the bat measured about an axis positioned six inches from the base of the knob of the bat by no more than twenty percent.

5. The ball bat of claim 1, wherein, when the bat is tested in accordance with the NCAA Standard for Testing Baseball Bat Performance, the bat has a maximum BBCOR value of less than or equal to 0.500.

6. The ball bat of claim 1, wherein the annular member is positioned between the center of percussion and the proximal end of the bat.

7. The ball bat of claim 1, wherein a first aspect ratio defined by the maximum height of the annular member over the width of the annular member is at least 0.5.

8. The ball bat of claim 1, wherein a second aspect ratio defined by the inside diameter of the barrel portion at the location of the annular member over the width of the annular member is at least 1.5.

9. The ball bat of claim 1, wherein the first set of projections engage have a height within the range of 0.002 to 0.060 inch.

10. The ball bat of claim 9, wherein the first set of projections are selected from the group consisting of serrated ridges, one or more helical ridges, annular ridges and combinations thereof.

11. The ball bat of claim 1, wherein the second set of projections have a height within the range of 0.002 to 0.060 inch.

12. The ball bat of claim 11, wherein the second set of projections are selected from the group consisting of serrated ridges, one or more helical ridges, annular ridges and combinations thereof.

13. The ball bat of claim 10, wherein the second set of projections have a height within the range of 0.002 to 0.060 inch.

14. The ball bat of claim 13, wherein the second set of projections are selected from the group consisting of serrated ridges, one or more helical ridges, annular ridges and combinations thereof.

15. The ball bat of claim 1, wherein at least one of the projections of the first set of projections and the second set of projections includes the leading edge and the trailing edge, wherein the leading edge of the first set of projections is arranged to oppose the leading edge of the second set of projection, wherein the projections are arranged to enable the initial insertion of the annular member into the barrel portion in a first direction from the distal end toward the proximal end of the frame, and, once engaged, inhibit movement of the annular member in a second direction from toward the distal end.

16. The ball bat of claim 1, wherein the first set of projections extend over only at least a portion of a central region of the barrel portion.

17. The ball bat of claim 1, further including an adhesive to facilitate attachment of the annular member to the barrel portion.

18. The ball bat of claim 1, wherein the annular member has a weight within the range of 0.4 to 1.85 ounces.

19. The ball bat of claim 1, wherein the annular member has a stiffness coefficient within the range of 9000 to 39000 lb/in.

20. The ball bat of claim 1, wherein the annular member has a radial cross-sectional area, and wherein the shape of the radial cross-sectional area is selected from the group consisting of a rectangular shape, a triangular shape, a round shape, an L-shape, a C-shape, an I-shape, a T-shape.

* * * * *